US005512719A

United States Patent [19]

Okada et al.

[11] Patent Number: 5,512,719

[45] Date of Patent: Apr. 30, 1996

[54] KEY SWITCH HAVING ELASTIC PORTIONS FOR FACILITATING ATTACHMENT OF SCISSORS-TYPE SUPPORT LINKAGE TO KEYTOP AND HOLDER, AND REMOVAL OF KEYTOP FROM LINKAGE

[75] Inventors: Hiroaki Okada, Kasugai; Isao Mochizuki, Kaizu; Takeyuki Takagi, Nagoya, all of Japan

[73] Assignee: Brother Kogyo Kabushiki Kaisha, Nagoya, Japan

[21] Appl. No.: 329,842

[22] Filed: Oct. 27, 1994

[30] Foreign Application Priority Data

Nov. 5, 1993 [JP] Japan ..... 5-276984

[51] Int. Cl.[6] ..... H01H 13/70

[52] U.S. Cl. ..... 200/344; 200/345

[58] Field of Search ..... 200/344, 345, 200/341, 512, 517, 343, 520, 515; 400/490

[56] References Cited

U.S. PATENT DOCUMENTS

| | | | |
|---|---|---|---|
| 4,433,225 | 2/1984 | Cowles . | |
| 4,580,022 | 4/1986 | Oelsch et al. . | |
| 4,771,146 | 9/1988 | Suzuki et al. | 200/344 |
| 4,902,862 | 2/1990 | Oelsch et al. | 200/344 |
| 5,268,545 | 12/1993 | Bruner | 200/345 |
| 5,278,371 | 1/1994 | Watanabe et al. | 200/344 |
| 5,278,372 | 1/1994 | Takagi et al. . | |
| 5,278,374 | 1/1994 | Takagi et al. | 200/344 |
| 5,280,147 | 1/1994 | Mochizuki et al. . | |
| 5,399,822 | 3/1995 | Sato et al. | 200/344 |

FOREIGN PATENT DOCUMENTS

| | | |
|---|---|---|
| 271124 | 6/1988 | European Pat. Off. . |
| 4039379 | 4/1992 | Germany . |
| 4-51388 | 12/1992 | Japan . |

*Primary Examiner*—David J. Walczak
*Attorney, Agent, or Firm*—Oliff & Berridge

[57] ABSTRACT

A key switch wherein a switching action is effected by movements of a keytop movably connected to a holder via a scissors-type support linkage which consists of first and second links connected pivotally about a common primary pivot shaft. The keytop, holder and first and second links include at least one special secondary pivot shaft each carried by a special support portion, and at least one special bearing portion each engaging the corresponding special secondary pivot shaft. The special support portion and/or the corresponding special bearing portion has/have an elastic portion which elastically yields to allow engagement of the special pivot shaft and the special bearing portion during assembling of the keytop, support linkage and holder.

27 Claims, 12 Drawing Sheets

FIG. 1
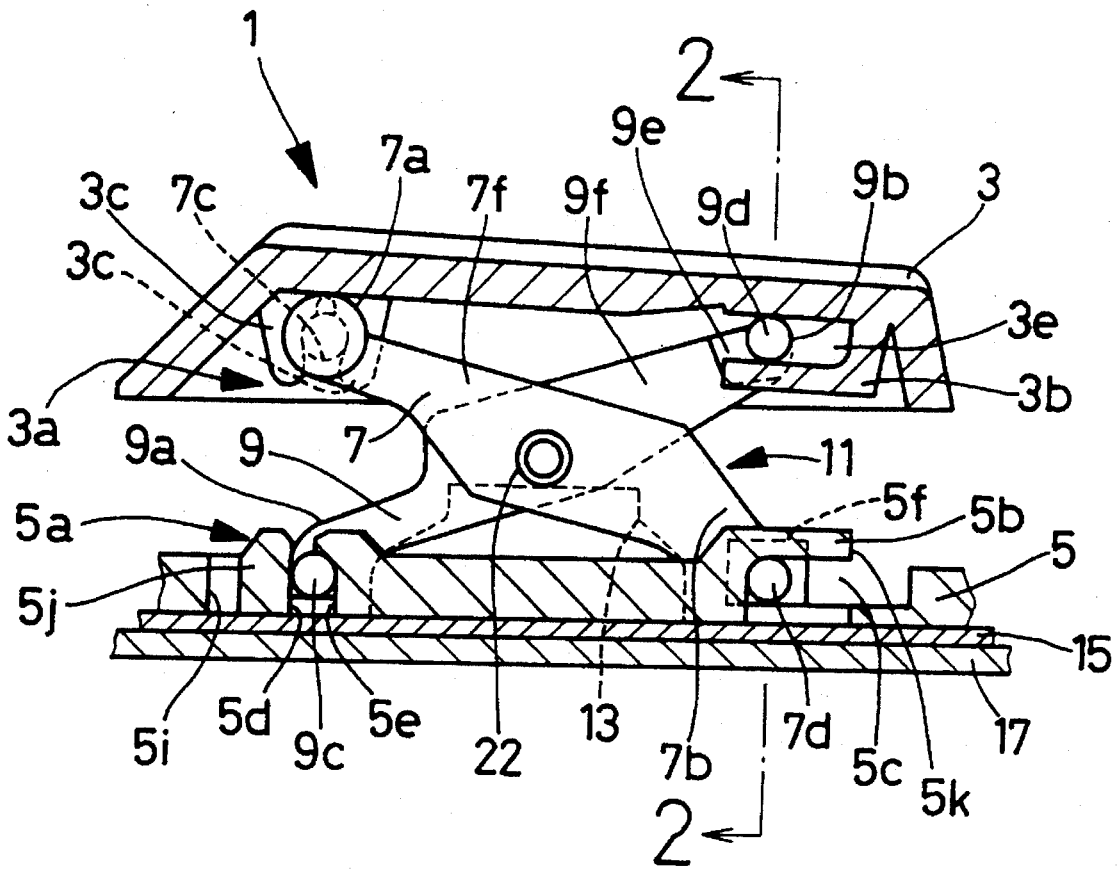
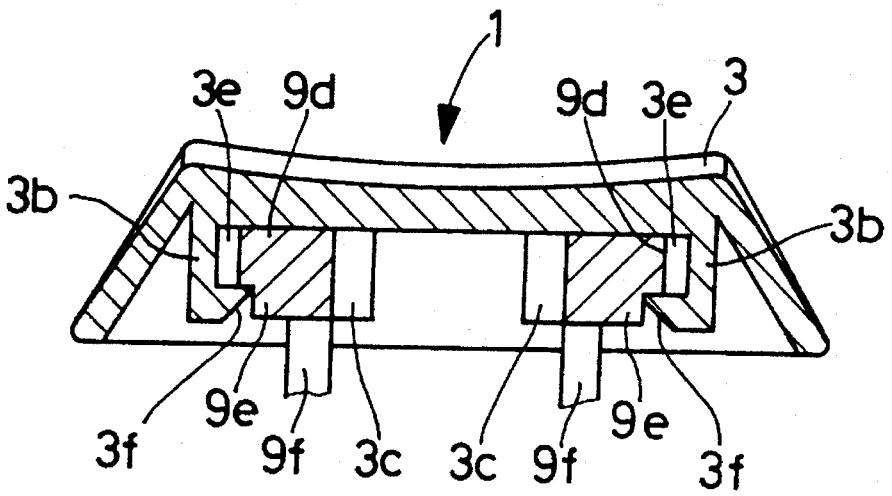
FIG. 2

KEY SWITCH HAVING ELASTIC PORTIONS FOR FACILITATING ATTACHMENT OF SCISSORS-TYPE SUPPORT LINKAGE TO KEYTOP AND HOLDER, AND REMOVAL OF KEYTOP FROM LINKAGE

BACKGROUND OF THE INVENTION

1. Field of the Invention

The present invention relates in general to a key switch provided on a keyboard or data input device used for a word processor and a personal computer, for example. More particularly, this invention is concerned with a key switch which is easy to assemble and which has a high degree of operating stability.

2. Discussion of the Prior Art

In a conventional key switch, the keytop is supported vertically movably for a switching action such that a key stem extending from the underside of the keytop is slidably supported and guided by a suitable guide portion formed on a holder plate. The operating stability of the key switch or keytop is improved by increasing the length of a guided portion of the key stem at which the key stem is slidably guided by the guide portion. On the other hand, the thickness of the keyboard is inevitably increased with an increase in the length of the guided portion of the key stem.

Recently, personal computers, word processors and similar electronic devices are required to have reduced size and weight for easy carrying or transportation. Keeping pace with this requirement, there is a growing need for reducing the thickness of the keyboard used as a data input device for such electronic devices.

The need indicated above may be satisfied by reducing the length of the guided portion of the key stem. However, this may lead to easy sticking or sliding instability of the key stem, and deteriorated operating stability of the key switch.

In view of the drawbacks of the conventional key switch and the growing need for reduced thickness of the keyboard, there was proposed a key switch which has a scissors-type support linkage for movably supporting the keytop for a switching action, in place of a conventionally used key stem slidably supported and guided by a holder plate. An example of such key switch is disclosed in U.S. Pat. No. 5,280,147.

The key switch having such scissors-type support linkage will be described by reference to FIGS. 14–16.

As shown in FIG. 14, the key switch includes a Keytop 101 made of a resin material. The Keytop 101 has a pair of spaced-apart front bearing portions 102 formed at a front end portion of its underside, and a pair of spaced-apart rear bearing portions 103 formed at a rear end portion of the underside. Each of the front bearing portions 102 has a circular engaging hole 104, and each of the rear bearing portions 103 has an elongated engaging groove 105. The key switch further includes a pair of spaced-apart rear bearing portions 126 formed on a holder plate 125, and a pair of spaced-apart front bearing portions 127 also formed on the holder plate 125. The holder plate 125 is made of a resin material. The front bearing portions 127 are spaced apart from the rear bearing portions 126 in a direction perpendicular to a direction in which the front bearing portions 127 are spaced apart from each other. The rear bearing portions 126 have respective elongated engaging grooves 128, while the front bearing portions 127 have respective circular engaging holes 129.

The keytop 101 is movably connected to the holder plate 125 through a scissors-type support linkage 106 consisting of a first link 107 and a second link 108 which are pivotally connected to each other as described below. These links 107, 108 are each formed of a resin material. The first link 107 has a pair of stationary pivot pins 113, 114 as its front or upper end, and a pair of sliding pins 115, 116 at its rear or lower end. The stationary pivot pins 113, 114 engage the respective circular engaging holes 104, while the sliding pins 115, 116 are received in the respective engaging grooves 128. The second link 108 has a pair of stationary pivot pins 121, 122 at its front or lower end, and a pair of sliding pins 123, 124 at its rear or upper end. The stationary pivot pins 121, 122 engage the respective engaging holes 129, while the sliding pins 123, 124 are received in the respective engaging grooves 105. Thus, the keytop 101 is connected to the holder plate 125 by the support linkage 106.

The two links 107, 108 are pivotally connected to each other at a pivot 132 as shown in FIG. 14. When the keytop 101 is pressed, the two links 107, 108 are pivoted about the pivot 132, and the pivot 132 is lowered and forced onto a cup-shaped rubber spring 131 formed on the holder plate 125, whereby the rubber spring 131 is collapsed for a switching action as well known in the art. Briefly, a movable electrode attached to the top wall of the rubber spring 131 is forced into contact with stationary electrodes disposed within the rubber spring 131.

As shown in FIG. 15, the first link 107 has a central portion 109, and two end portions 110, 111 at the opposite ends of the central portion 109 such that the portions 109–111 are integral with each other. The central portion 109 has a shaft 112 laterally extending from one of its opposite sides. As described below, the shaft 112 is inserted through a hole 120 formed through the second link 108 when the two links 107, 108 are assembled into the support linkage 106. The end portion 110 has opposite longitudinal ends 110A, 110A from which the two stationary pivot pins 113, 114 extend for engagement with the engaging holes 104. The end portion 111 is generally C-shaped as viewed in the plan view of FIG. 15, and has opposite longitudinal ends 111A, 111A from which the sliding pins 115, 116 extend for sliding engagement with the engaging grooves 128.

As shown in FIG. 16, the second link 108 has a central portion 117, and two end portions 118, 119 at the opposite ends of the central portion 117 such that the portions 117–119 are integral with each other. The central portion 117 has the above-indicated hole 120 through which the shaft 112 of the first link 107 is inserted. The end portion 118 is generally C-shaped as seen in the plan view of FIG. 16, and has opposite longitudinal ends 118A, 118A from which the stationary pivot pins 121, 122 extend for engagement with the engaging holes 129. The end portion 119 has opposite longitudinal ends 119A, 119A from which the sliding pins 123, 124 extend for sliding engagement with the engaging grooves 105.

The support linkage 106 is prepared by assembling the first and second links 107, 108 such that the shaft 112 extending from the central portion 109 of the link 107 is inserted through the hole 120 formed through the central portion 117 of the link 108. The shaft 112 cooperate with the hole 120 to constitute the pivot 132 indicated in FIG. 14, about which the two links 107, 108 are pivotable relative to each other.

The key switch constructed as described above suffers from difficulty in the assembling process. That is, it is difficult and cumbersome to connect the support linkage 106 to the holder plate 125, and connect the keytop 101 to the support linkage 106.

In assembling the key switch of FIG. 14, the support linkage 106 is first produced by assembling the first and second links 107, 108 in the form of scissors having the pivot 132. Then, the stationary pivot pins 121, 122 at the end portion 118 of the second link 108 are forced or press-fitted into the engaging holes 129 formed in the front bearing portions 127 of the holder plate 125. This press-fitting of the pins 121, 122 into the holes 128 is effected utilizing elasticity of the resin materials of the end portion 118 (118A) and pins 121, 122 and the front bearing portions 127. Accordingly, it is difficult and cumbersome to achieve precise positioning of the pins 121, 122 with respect to the holes 129.

Similar difficulty is encountered when the sliding pins 115, 116 at the end portion 111 of the first link 107 are forced into the engaging grooves 128 formed in the rear bearing portions 126 of the holder plate 125, while utilizing the elastic property of the resin material.

After the linkage 106 is attached to the front and rear bearing portions 126 and 127 of the holder plate 125, the keytop 101 is attached to the linkage 106. Described more specifically, the stationary pivot pins 113, 114 of the first link 107 are forced or press-fitted into the engaging holes 104 at the front bearing portions 102 of the keytop 101, while the sliding pins 123, 124 of the second link 108 are forced or press-fitted into the engaging grooves 105 at the rear bearing portions 103 of the keytop 101. These press-fitting operations are also effected by utilizing the elastic property of the resin materials of the pins 113, 114, 123, 124 and the front and rear bearing portions 102, 103. Thus, similar difficulty is encountered when the pins 113, 114, 123, 124 are forced into the holes 104 and grooves 105.

As described above, the connection of the linkage 106 to the holder plate 125 and the connection of the keytop 101 to the linkage 106 are effected by utilizing the elasticity of the resin materials of the links 107, 108, holder plate 125 and keytop 101. Accordingly, the assembling procedure of the key switch of FIGS. 14–16 is difficult and time-consuming, leading to an increased cost of manufacture of the key switch and an increased cost of manufacture of a keyboard using the key switch.

SUMMARY OF THE INVENTION

It is therefore an object of the present invention to provide a key switch which is relatively easy to assemble and which has a high degree of operating stability.

The above object may be achieved according to the principle of the present invention, which provides a key switch having a keytop, a holder spaced apart from and opposed to the keytop, a support linkage for connecting the keytop and the holder such that the keytop is movably supported and guided by the support linkage, and a switching portion operated by movements of the keytop to effect a switching action. The support linkage includes a first link and a second link which are connected to each other in the form of scissors pivotally about a common primary pivot shaft. Each of opposite end portions of each of the first and second links has one of a secondary pivot shaft and a bearing portion, while each of four portions of the keytop and the holder which correspond to the opposite end portions of the first and second links has the other of the secondary pivot shaft and the bearing portion. The bearing portion is adapted to support the secondary pivot shaft at least pivotally about an axis of the secondary pivot shaft. The present key switch is characterized in that the secondary pivot shafts include at least one special secondary pivot shaft each of which is carried by a special support portion, and the bearing portions including at least one special bearing portion which engages the at least one special secondary pivot shaft. At least one of the special support portion and the corresponding special bearing portion has an elastic portion which elastically yields to allow engagement of the special pivot shaft and the special bearing portion when the keytop is moved toward the holder with the support linkage being interposed between the keytop and the holder before the engagement of the special pivot shaft and the special bearing portion, that is, when the keytop, support linkage and holder are assembled to connect the keytop to the holder via the support linkage.

In the present key switch, one or both of the special support portion and the corresponding special bearing portion which are provided on the keytop, support linkage and holder has/have an elastic portion which elastically yields to permit the special pivot shaft to be pressed into the corresponding special bearing portion when the key switch is assembled. Thus, the elastic portion facilitates the attachment of the support linkage to the holder and the attachment of the keytop to the support linkage. Further, the scissors-type support linkage permits smooth guiding of the keytop when it is moved for a switching action, and thereby assures a high degree of operating stability of the key switch, while maintaining a sufficiently reduced thickness of a keyboard in which the key switch is incorporated.

In a first preferred form of the present invention, the first link is generally U-shaped and includes a pair of first arm portions and a first connecting portion which connect the first arm portions at corresponding fixed ends thereof such that the first arm portions are parallel to each other, while the second link is generally H-shaped and includes a pair of second arm portions and a second connecting portion which connect the second arm portions at least at middle parts thereof such that the second arm portions are parallel to each other. In this case, one of the pairs of first and second arms has a pair of bosses while the other of the pairs of first and second arms has a pair of holes, so that the first and second links are connected pivotally relative to each other such that the second arms are disposed inside the first arms and such that the pair of bosses engage the pair of holes so as to provide the common primary pivot shaft.

In a second preferred form of the invention, one of the first and second links has an abutting portion which is abuttable against the other of the first and second links so as to limit an amount of relative pivotal movement of the first and second links in a direction that permits the keytop and the holder to move toward each other.

In one advantageous arrangement of the above first preferred form of the invention, at least one of the pair of second arms of the second link has an abutting portion which is abuttable against at least one of the pair of first arms of the first link so as to limit an amount of relative pivotal movement of the first and second links in a direction that permits the keytop and the holder to move toward each other. The abutting portion is formed at an end of the above-indicated at least one second arm which is moved toward a free end of the first link remote from the fixed end when the keytop is moved toward the holder. The abutting portion extends from the at least one second arm in a direction parallel to an axis of the common primary pivot shaft and outwardly of the second link.

In a third preferred form of this invention, the key switch further includes removal facilitating means for facilitating removal of the keytop from the support linkage prior to removal of the support linkage from the holder when a force is applied to the keytop in a direction away from the holder after the first and second links are connected to the keytop and the holder.

In one advantageous arrangement of the above third preferred form of the invention, the above-indicated at least one special bearing portion includes two open bearing portions which are opposed to each other and which are provided on the side of the keytop and the holder, respectively. These two open bearing portions have respective open bearing holes which pivotably receive the corresponding special secondary pivot shafts. Each open bearing hole has an inner portion and an open end which has a smaller dimension than the inner portion as measured in a direction perpendicular to a direction of movement of the keytop. Each of the two open bearing portions elastically yields to permit the corresponding special secondary pivot shaft to move into and out of the inner portion of the open bearing hole through the open end. In the present arrangement, the removal facilitating means comprises one of the two open bearing portions which is provided on the side of the keytop. The above-indicated one open bearing portion is shaped and/or dimensioned so as to permit removal of the corresponding special secondary pivot shaft therefrom prior to removal of the special secondary pivot shaft from the other of the two open bearing portions which is provided on the side of the holder. In the present arrangement, the open bearing portion provided on the side of the holder may consist of an offset type open bearing portion wherein the open end of the open bearing hole is offset from a center of the inner portion of the open bearing hole in an offset direction away from another bearing portion provided on the side of the holder. The offset type open bearing portion is effective to prevent the corresponding secondary pivot shaft from being removed therefrom. In this case, the holder may have an opening formed through an entire thickness thereof, and a cantilever which extends into the opening from a surface of the opening parallel to the offset direction. The opening has a primary bearing surface perpendicular to the offset direction, while the cantilever has a free end portion which has an auxiliary bearing surface and which cooperates with the primary bearing surface to define the open bearing hole of the offset type bearing portion. The cantilever which provides the auxiliary bearing surface comparatively easily undergoes elastic deformation, allowing the corresponding secondary pivot shaft to be forced into the bearing hole. On the other hand, the portion of the holder which defines the open end portion of the primary bearing surface is comparatively difficult to elastically yield, thereby preventing the corresponding secondary pivot shaft from being removed from the open bearing hole.

In another advantageous arrangement of the above-described third preferred form of this invention, the above-indicated at least one special bearing portion includes two open bearing portions which are opposed to each other and which are provided on the side of the keytop and the holder, respectively. The two open bearing portions have respective open bearing holes which pivotably receive the corresponding special secondary pivot shafts and which are open toward each other. Each of these two open bearing holes have a smaller dimension at an open end thereof than at an inner portion thereof, as measured in a direction perpendicular to a direction of movement of the keytop. Each open bearing portion elastically yields to permit the corresponding special secondary pivot shaft to move into and out of the inner portion of the open bearing hole through the open end. In this instance, the above-indicated removal facilitating means may comprise another bearing portion which is provided on the side of the holder and which comprises stop means for inhibiting a movement of the secondary pivot shaft which engages the another bearing portion, in a direction toward the open bearing portion provided on the side of the holder, at least when the keytop is moved away from the holder to remove the keytop from the support linkage. When the keytop is pulled for removal from the support linkage, the secondary pivot shafts on the side of the holder tend to be moved toward each other, whereby the secondary pivot shaft received in the open bearing hole on the side of the holder tends to be moved in an oblique direction, while the secondary pivot shaft received in the open bearing hole provided on the side of the keytop tends to be moved toward the holder, whereby the secondary pivot shaft on the side of the holder tends to be removed from the corresponding open bearing hole prior to the removal of the secondary pivot shaft on the side of the keytop from the corresponding open bearing hole.

In another advantageous arrangement of the above-indicated first preferred form of the present invention, the above-indicated at least one special bearing portion includes an opening bearing portion having an open bearing hole which pivotably receives the corresponding special secondary pivot shaft. This open bearing hole has an inner portion and an open end which has a smaller dimension than the inner portion as measured in a direction perpendicular to a direction of movement of the keytop. The open bearing portion elastically yields to permit the corresponding special secondary pivot shaft to move into and out of the inner portion of the open bearing hole through the open end. In this case, at least one of the pair of first arms and the pair of second arms carries the special secondary pivot shafts at end portions of the arms, and the end portions of the at least one of the pairs of first and second arms are connected by the connecting portion. Since the end portions of the arms having the secondary pivot shafts are connected to each other by the connecting portion, the arms do not easily elastically yield. This arrangement is desirable to promote the removal of the secondary pivot shafts from the open bearing holes.

In a third advantageous arrangement of the above-described third preferred form of this invention, the removal facilitating means comprises deformation limiting means for limiting elastic deformation of the end portion of one of the first and second links, which end portion is connected to the holder as a permanently connected end portion and does not have the special support portion.

According to a first desirable feature of the above arrangement, the deformation limiting means preferably comprise stops disposed adjacent to the permanently connected end portion of the above-indicated one of the first and second links such that the permanently connected end portion is interposed between the stops and the bearing portion which engages the secondary pivot shaft carried by the permanently connected end portion. The stops prevent elastic deformation of the permanently connected end portion in a direction away from the bearing portion. The bearing portion disposed adjacent to the permanently connected end portion which is disposed adjacent to the stops has an engaging groove which permits a sliding movement of the secondary pivot shaft in a direction substantially perpendicular to a direction of movements of the keytop, and an inlet which communicates with one end of the engaging groove and which is open in a direction away from the holder. The bearing portion adjacent to the connected fixed end portion is preferably shaped so as not to prevent a movement of the secondary pivot shaft into the engaging groove through the inlet.

According to a second desirable feature of the above advantageous arrangement, the first link is generally U-shaped and includes a pair of first arm portions and a first connecting portion which connect the first arm portions at corresponding fixed ends thereof such that the first arm portions are parallel to each other, and while the second link is generally H-shaped and includes a pair of second arm portions and a second connecting portion which connect the second arm portions at least at middle parts thereof such that the second arm portions are parallel to each other. In this case, one of the pairs of first and second arms may have a pair of bosses while the other of the pairs of first and second arms has a pair of holes, so that the first and second links are connected pivotally relative to each other such that the second arms are disposed inside the first arms and such that the pair of bosses engage the pair of holes so as to provide the common primary pivot shaft. The first arms may carry the secondary pivot shafts at free ends thereof which are remote from the fixed ends and which are provided on the permanently connected end portion of the first link. In this instance, the first arms are connected at the free ends to the holder such that the secondary pivot shafts extending outwardly of the first link engage the corresponding bearing portions provided on the holder, and the second arms are connected to the keytop at ends thereof which correspond to the free ends of the first arms. In this case, the deformation limiting means may comprise stops disposed adjacent to the free ends of the arms such that the free ends are interposed between the stops and the bearing portions provided on the holder, the stops preventing elastic deformation of the free ends in a direction away from the bearing portion.

According to the above first desirable feature of the third advantageous arrangement of the above third preferred form of the invention, at least one of the second arms preferably has an abutting portion which is abuttable against at least one of the first arms so as to limit an amount of relative pivotal movement of the first and second links in a direction that permits the keytop and the holder to move toward each other. In this case, the abutting portion is formed at the end of the above-indicated at least one second arm which is connected to the keytop and which corresponds to the free ends of the first arm. Further, the stops preferably have a larger height than the secondary pivot shaft carried at the free ends of the first arms, as measured in a direction from the holder toward the keytop.

In a fourth advantageous arrangement of the third preferred form of this invention, the first link is generally U-shaped and includes a pair of first arm portions and a first connecting portion which connect the first arm portions at corresponding fixed ends thereof such that the first arm portions are parallel to each other, while the second link is generally H-shaped and includes a pair of second arm portions and a second connecting portion which connect the second arm portions at least at middle parts thereof such that the second arm portions are parallel to each other. In this case, one of the pairs of first and second arms has a pair of bosses while the other of the pairs of first and second arms has a pair of holes, and the first and second links are connected pivotally relative to each other such that the second arms are disposed inside the first arms and such that the pair of bosses engage the pair of holes so as to provide the common primary pivot shaft. In this instance, the removal facilitating means comprises free ends of the first arms which are remote from the fixed ends and which are connected to the keytop, and ends of the second arms which correspond to the free ends of the first arms and which are connected to the holder. Each of the first arms has at the free end one of the special secondary pivot shaft and the special bearing portion which are formed at an inner portion of the free end, while the keytop has the other of the special secondary pivot shaft and the special bearing portion which engages the one of the special secondary pivot shaft and the special bearing portion.

In a fourth preferred form of this invention, each of the opposite ends of the first and second links has the secondary pivot shaft, and the bearing portion which engages the corresponding secondary pivot shaft provided at one of the opposite ends of each of the first and second links consists of a sliding type bearing portion which supports the corresponding secondary pivot shaft pivotally and slidably movably in a direction substantially perpendicular to a direction of movements of the keytop. In this case, the bearing portion which engages the corresponding secondary pivot shaft provided at the other of the opposite ends of the each of the first and second links consists of a non-sliding type bearing portion which supports the corresponding secondary pivot shaft pivotably and so as to prevent sliding movements of the corresponding secondary pivot shaft in the direction substantially perpendicular to the direction of movement of the keytop.

In one advantageous arrangement of the above fourth preferred form of the invention, at least one of the sliding type bearing portions provided on the keytop and the sliding type bearing portion provided on the holder includes an end portion which has a slant end face formed for abutting engagement with the corresponding secondary pivot shaft during a movement of the corresponding secondary pivot shaft toward the keytop or the holder, for thereby causing elastic deformation of the end portion of the first or second link carrying the corresponding secondary pivot shaft in a direction away from the sliding type bearing portion.

In a fifth preferred form of the invention, the secondary pivot shafts for connecting one of the opposite ends of each of the first and second links to the keytop and the secondary pivot shafts for connecting the other of the opposite ends of each of the first and second links include at least one secondary pivot shaft which is formed on the keytop or the holder and which engages at least one bearing portion formed on the first link or the second link.

In a third advantageous arrangement of the above-indicated first preferred form of the invention wherein the generally U-shaped first link and the generally H-shaped second link are used, the second connecting portion of the second link has a presser portion which acts on the switching portion to effect the switching action when the keytop is moved toward the holder.

BRIEF DESCRIPTION OF THE DRAWINGS

The above and optional objects, features and advantages of the present invention will become more apparent by reading the following detailed description of presently preferred embodiments of the invention, when considered in connection with the accompanying drawings, in which:

FIG. 1 is an elevational view in cross section of a key switch constructed according to a first embodiment of the present invention;

FIG. 2 is an elevational view in cross section of a keytop and a second link of the key switch, taken along 2—2 of FIG. 1;

FIG. 8(*b*) is a plan view of a holder of the key switch of FIG. 8(*a*);

DETAILED DESCRIPTION OF THE PREFERRED EMBODIMENT

Figure 3:
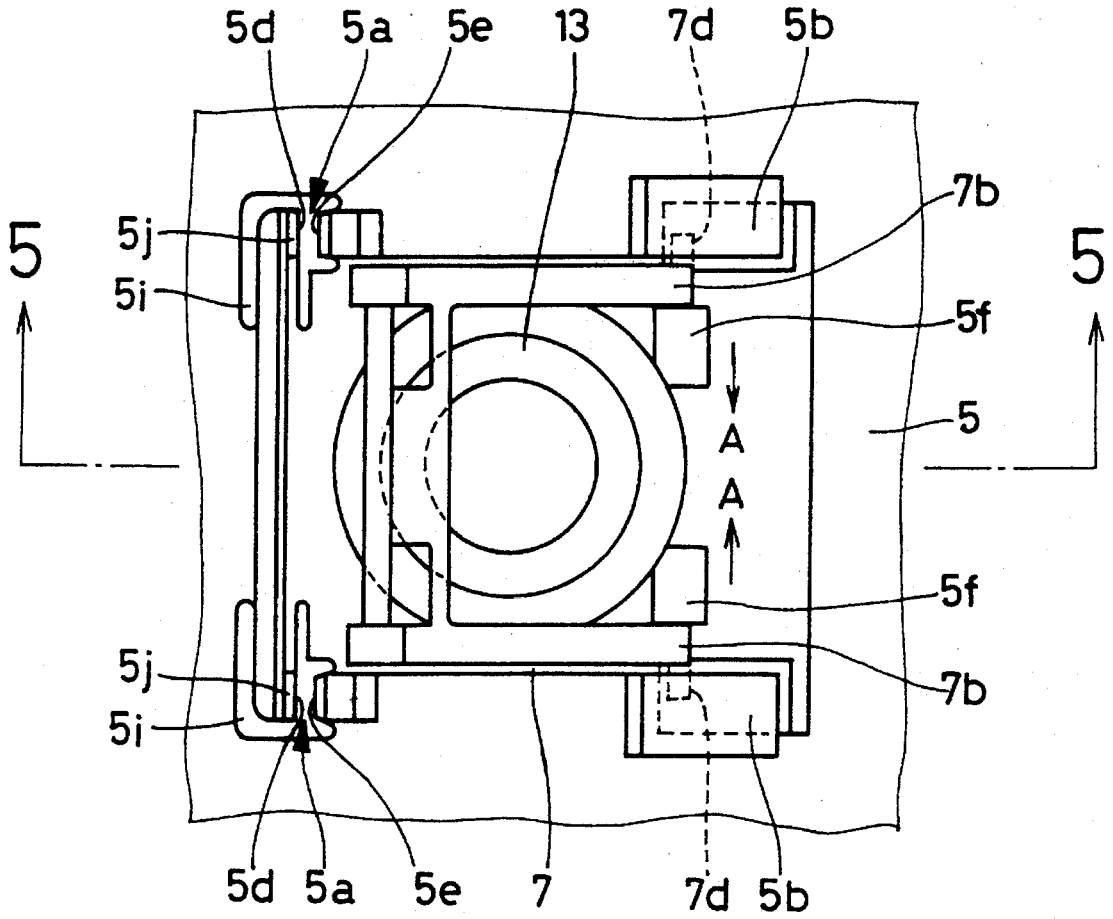
FIG. 3 is a plan view of a holder and a first link of the key switch of FIG. 1.

Referring first to the elevational view of FIG. 1, the key switch is shown generally at 1. The key switch 1 is used for a keyboard of a computer, for example. The key switch 1 includes a keytop 3 at which the key switch 1 is pressed by the operator, a holder 5 spaced apart from and opposed to the keytop 3, and a pair of two links 7, 9 which are mutually pivotally connected to each other so as to intersect each other in the form of scissors or a letter "X", as seen in FIG. 1. The key switch 1 further includes a rubber spring 13, on which the second link 9 acts to effect a switching action of the key switch 1, as described below. The second link 9 cooperates with the first link 7 to constitute a scissors-type support linkage 11 adapted to connect the keytop 3 and the holder 5 such that the keytop 3 is vertically movably supported and guided by the support linkage 11 when the keytop 3 is pressed and released.

Figure 7A:
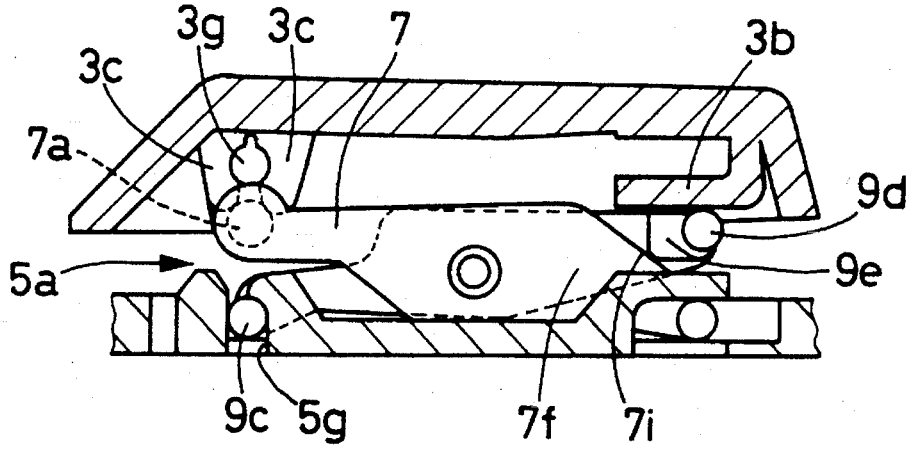
FIGS. 7(*a*), 7(*b*) and 7(*c*) are view for explaining the assembling method of the key switch of FIG. 1.
Figure 7B:
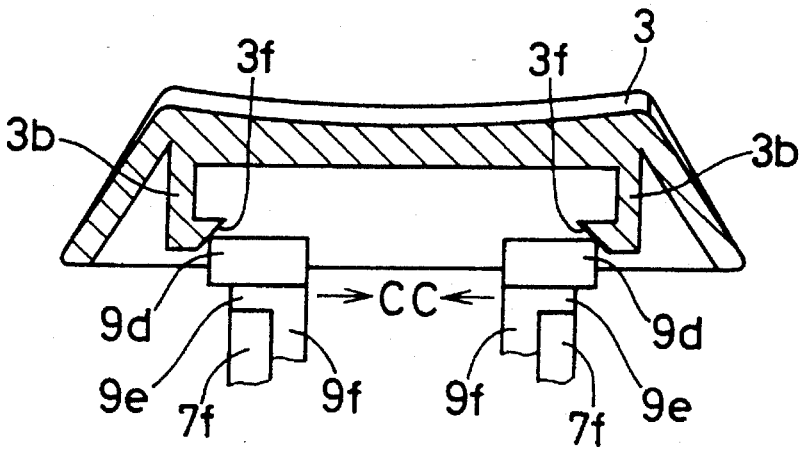
Figure 7C:
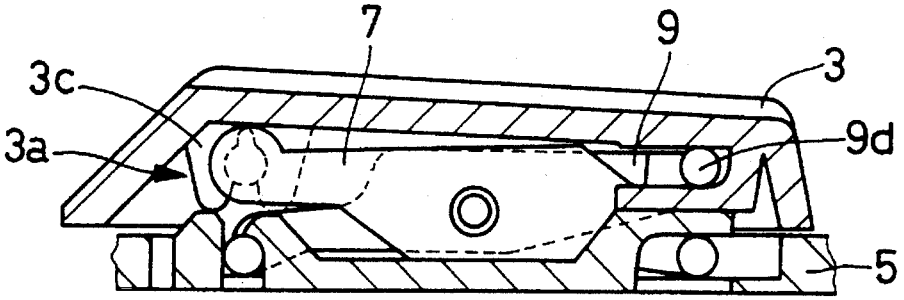

The keytop 3 is a molding of a suitable synthetic resin such as an ABS resin, for example, and has an indicium such as an alphabetic letter printed on its top surface. On the underside of the keytop 3, there are formed two front bearing portions 3*a* and two rear bearing portions 3*b*. The two front bearing portions 3*a* support respective stationary pivot pins 7*c* provided at a front end portion 7*a* of the first link 7, such that the first link 7 is pivotable about the pins 7*c*. The two front bearing portions 3*a* are spaced from each other in the direction in which the stationary pivot pins 7*c* extend. The two rear bearing portions 3*b* receive respective sliding pivot pins 9*d* provided at respective rear end portions 9*b* of the second link 9, such that the sliding pivot pins 9*d* are slidable on the rear bearing portions 3*b*. The two rear bearing portions 3*b* are spaced from each other in the direction in which the pins 9*d* extend, as shown in FIG. 2. Described more specifically, each front bearing portions 3*a* consists of two engaging projections 3*c* extending from the inner surface of the keytop 3. The two projections 3*c* define a bearing hole 3*g* for receiving the stationary pivot pin 7*c*, as indicated in FIG. 7(*a*). This bearing hole 3*g* is open downward and has a smaller dimension at its lower open end than at the inner or upper portion, as measured in the direction perpendicular to the direction of movement of the keytop 3. Each rear bearing portion 3*b* is generally L-shaped as shown in FIG. 2 (taken along line 2—2 of FIG. 1), and has an engaging groove 3*e* for slidably receiving the sliding pivot pin 9*d*. The engaging grooves 3*e* formed at the two rear bearing portions 3*b* are open toward each other inwardly of the keytop 3. The lower part of each bearing portion 3*b* which partially defines the engaging groove 3*e* has an inclined or slant end face 3*f* at the inner end as seen in the direction of extension of the pin 9*d*, as shown in FIG. 2. The slant inner end face 3*f* facilitates assembling of the keytop 3 and the support linkage 11 (more precisely, second link 9), as described below.

The holder 5 is formed of a flexible synthetic resin material, and attached to the upper surface of a flexible circuit board 15, as shown in FIG. 1. The holder 5 has two front bearing portions 5*a*, and two rear bearing portions 5*b*. The two front bearing portions 5*a* support respective stationary pivot pins 9*c* provided at respective front end portions 9*a* of the second link 9, such that the second link 9 is pivotable about the pins 9*c*. The two front bearing portions 5*a* are spaced from each other in the direction in which the stationary pivot pins 9*c* extend, as shown in the plan view of FIG. 3. In FIG. 3, the second link 9 is omitted, for easy showing of the holder 5. The two rear bearing portions 5*b* receive respective sliding pins 7*d* provided at respective rear end portions 7*b* of the first link 7, such that the sliding pins 7*d* are slidable on the bearing portions 5*b*. The two rear bearing portions 5*b* are spaced from each other in the direction in which the pins 7*d* extend, as also shown in FIG. 3.

As is apparent from the following description, the rear end portions 7*b* of the first link 7 and the front end portions 9*a* of the second link 9 are permanently connected to the rear and front bearing portions 5*b*, 5*a* of the holder 5. These permanently connected rear and front end portions 7*b*, 9*a* are not usually and cannot be removed from the holder 5 once the support linkage 11 are attached to the holder 5.

Each of the front bearing portions 5*a* of the holder 5 has a bearing hole 5*g* for receiving the corresponding stationary pivot pin 9*c*, as indicated in FIG. 7(*a*). Described more specifically, the holder 5 has two openings 5*i* formed through the entire thickness at a portion thereof corresponding to the two front bearing portions 3*a* of the keytop 3, as shown in FIGS. 1 and 3. A cantilever 5*j* extends into each opening 5*i* in the direction in which the two openings 5*i* are spaced apart from each other. In other words, the cantilever 5*j* extends from a surface of the opening 5*i* parallel to the direction in which the front and rear bearing portions 5*a* and 5*b* are spaced apart from each other. The cantilever 5*j* has a free end portion which has an auxiliary bearing surface 5*d*, while the opening 5*i* has a primary bearing surface 5*e* which is parallel and opposed to the auxiliary bearing surface 5*d*. The primary bearing surface 5*e* is located nearer to the rear bearing portion 5*b* than the auxiliary bearing surface 5*d*. These auxiliary and primary bearing surfaces 5*d*, 5*e* which are formed by the opening 5*i* and cantilever 5*j* cooperate with each other to define the bearing hole 5*g*.

The bearing hole 5g is open upward through an upper open end, and has a smaller dimension at the open end than at the lower inner portion, as measured in the direction perpendicular to the direction of movements of the keytop 3, that is, as measured in the direction in which the front and rear bearing portions 5a and 5b are spaced apart from each other. The smaller open end of the bearing hole 5g is partly defined by a protrusion from the upper end of the primary bearing surface 5e, and is offset from the center of the inner portion of the bearing hole 5g in the direction from the primary bearing surface 5e toward the auxiliary bearing surface 5d.

Each rear bearing portion 5b has an engaging groove 5c as shown in FIG. 1, which permits horizontal sliding movements of the sliding pivot pin 7d in the direction in which the front and rear bearing portions 5a, 5b are spaced apart from each other, that is, in the direction perpendicular to the direction of movements of the keytop 3. The rear bearing portion 5b further has an inlet 5k which communicates with one end of the engaging groove 5c. The inlet 5k is open in the direction away from the holder.

As most clearly shown in the plan view of FIG. 3, the holder 5 is formed with a pair of rectangular stops 5f disposed adjacent to and inwardly of the rear end portions (permanently connected end portion) 7b of the first link 7, which end portions 7b are slidable on the rear bearing portions 5b. Each stop 5f takes the form of a rectangular parallelepiped. The rectangular stops 5f function to prevent inward deflection (in the directions indicated by arrows A in FIG. 3) of the first link 7 at its rear end portions 7b, for thereby avoiding disengagement of the sliding pins 7d away from the bearing portions 5b of the holder 5. The stops 5f have a height larger than the diameter of the sliding pins 7d, as is apparent from FIG. 1.

Figure 4A:
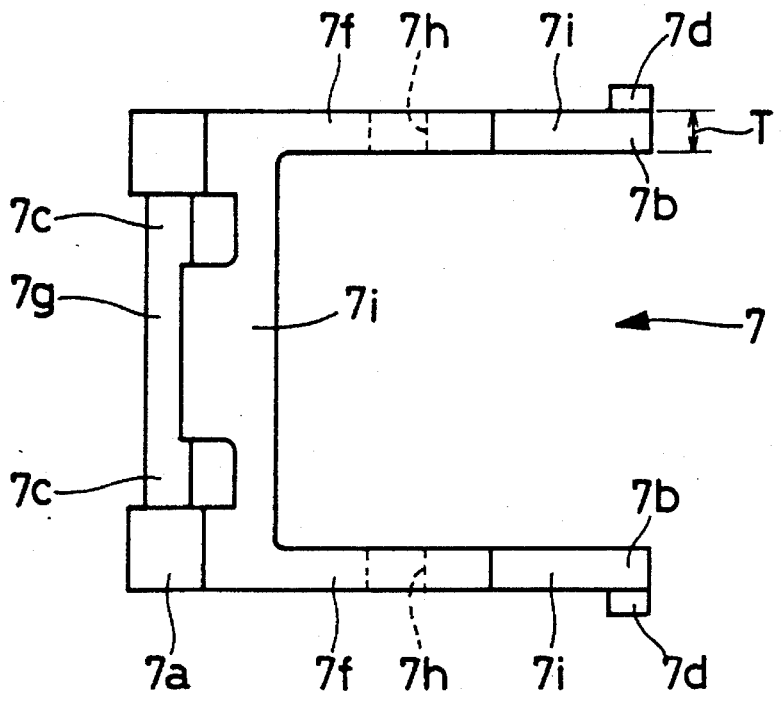
FIG. 4(*a*) and 4(*b*) are plan view of the first and second links, respectively, of the key switch of FIG. 1.
Figure 4B:
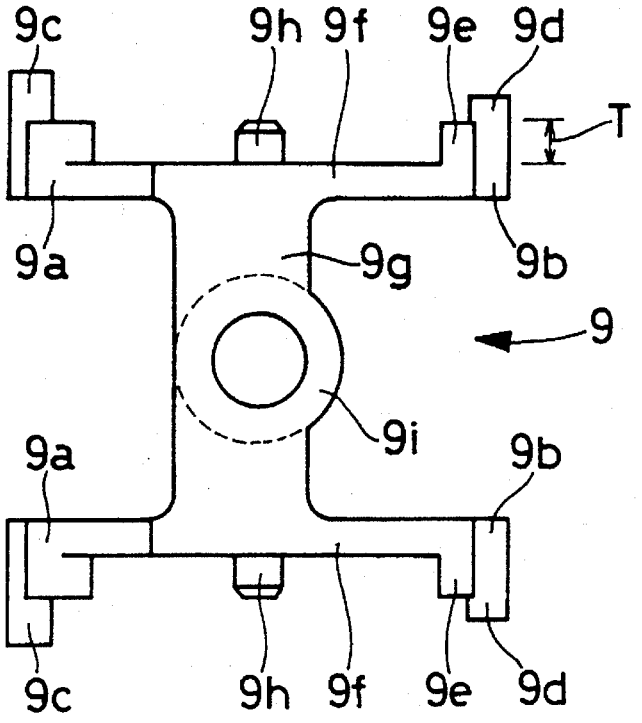

The first link 7, which cooperates with the second link 9 to constitute the support linkage 11, is generally U-shaped, having a pair of first arm portions 7f in the form of sheets, and a pivot rod 7g and connecting portion 7i which connect the first arm portions 7f at the front end portion 7a, as shown in the plan view of FIG. 4(*a*). The pivot rod 7g has the two stationary pivot pins 7c at its opposite ends. The two first arm portions 7f has the respective sliding pivot pins 7d at the rear end portions 7b. The sliding pivot pins 7d extend from the first arm portions 7f outwardly of the link 7, in the opposite directions away from each other. Each first arm portion 7f has a hole 7h formed at an intermediate part thereof, so that bosses 9h formed on the second link 9 as shown in FIG. 4(*b*) engage the holes 7h formed in the first arm portions 7f of the first link 7.

The holes 7h and bosses 9h constitute a pivot 22 which serves as a common primary pivot shaft about which the two links 7, 9 are pivoted relative to each other. In this respect, the pivot pins 7c, 7d, 9c, 9d are considered to be secondary pivot shafts.

The second link 9, which is shown in the plan view of FIG. 4(*b*), is H-shaped having a pair of second arm portions 9f and a connecting portion 9g connecting the second arm portions 9f at middle parts thereof. The second arm portions 9f have the respective stationary pivot pins 9c at the front end portions 9a. The stationary pivot pins 9c extend outwardly of the link 9 in the opposite directions. The bosses 9h are formed at the ends of the connecting portion 9g, so as to extend outwardly of the link 9, for engagement with the holes 7h, so that the second link 9 is connected to the first link 7 such that the two links 7, 9 are pivotable about the axes of the bosses 9h.

Each of the two second arm portions 9f of the second link 9 has an abutting portion in the form of an outward projection 9e formed adjacent to the sliding pivot pin 9d. Like the pin 9d, the abutting projection 9e extends outwardly of the link 9. When the keytop 3 is assembled as described below in detail, the abutting projections 9e of the second link 9 are brought into abutting contact with respective upper surface areas 7i of the first link 7, which areas 7i are adjacent to the rear end portions 7b, as shown in FIG. 4(*a*). The length of extension of the abutting projections 9e of the second link 9 is determined to be substantially equal to the thickness T of the first arm portions 7f of the first link 7, as indicated in FIGS. 4(*a*) and 4(*b*).

The connecting portion 9g of the second link 9 has a presser portion 9i formed at a central part thereof, as shown in FIG. 4(*b*). When the keytop 3 is pressed, the second link 9 is moved down, and the rubber spring 13 is pressed by the presser portion 9i, with the presser portion 9i held in contact with the rubber spring 13.

Figure 5:
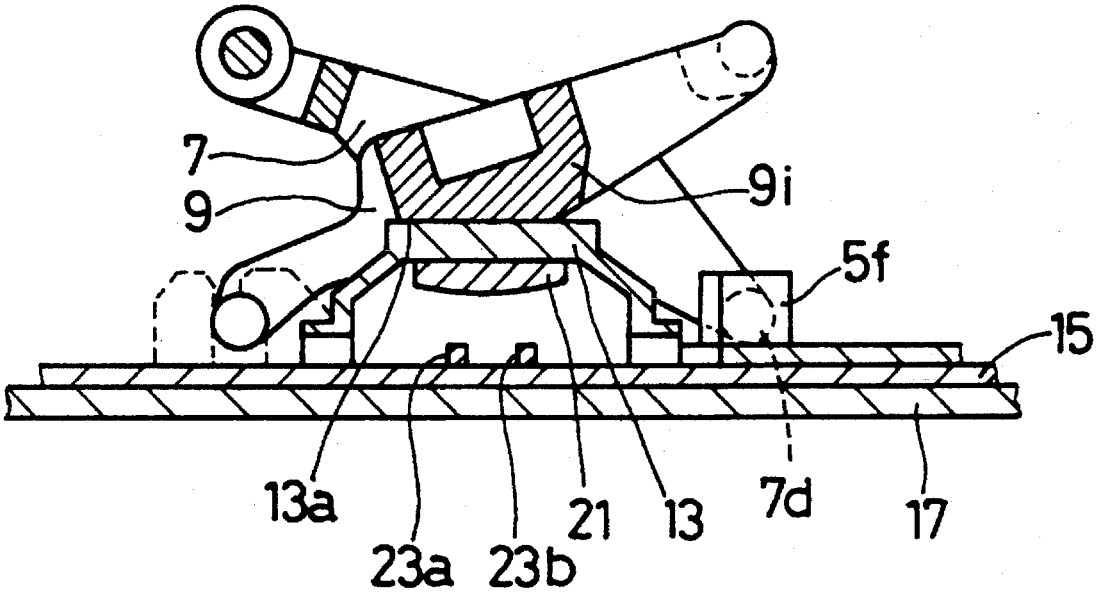
FIG. 5 is an elevational view in cross section of the key switch of FIG. 1, taken along line 5—5 in FIG. 3.

The rubber spring 13 takes the form of an inverted cup bonded to the surface of the flexible circuit board 15, as shown in the cross sectional view of FIG. 5 taken along line 5—5 of FIG. 3. The rubber spring 13 has an upper surface 13a held in contact with the presser portion 9i of the second link 9. The rubber spring 13 carries a movable electrode 21 attached to the underside of the top wall which has the upper surface 13a. In the surface area of the circuit board 15 which is enclosed by the inverted cup of the rubber spring 13, there are disposed two switching stationary electrodes 23a, 23b such that these stationary electrodes 23a, 23b are opposed to the movable electrode 21. When the keytop 3 is pressed, the movable electrode 21 is brought into contact with the stationary electrodes 23a, 23b, as a result of elastic deformation or collapse of the rubber spring 13 by the presser portion 9i of the second link 9.

The holder 5 and the flexible circuit board 15 are supported by an underlying support plate 17, so that each of the key switches 1 provided on a keyboard is supported by the support plate 17.

There will next be described a procedure for assembling the key switch 1. The procedure includes the following four steps:

(1) Initially, the flexible circuit board 15 and the holder 5 are placed on the support plate 17.

Figure 6A:
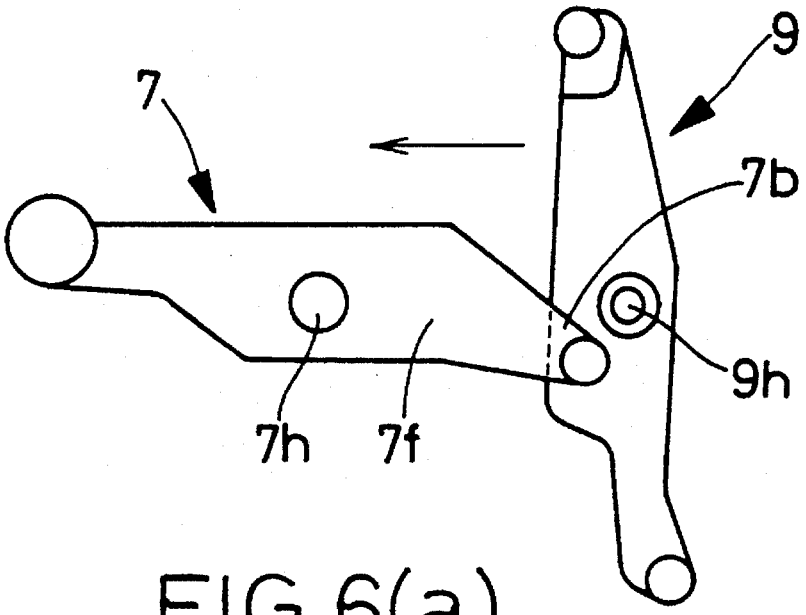
FIGS. 6(*a*) and 6(*b*) are views for explaining a method of assembling the key switch of FIG. 1.
Figure 6B:
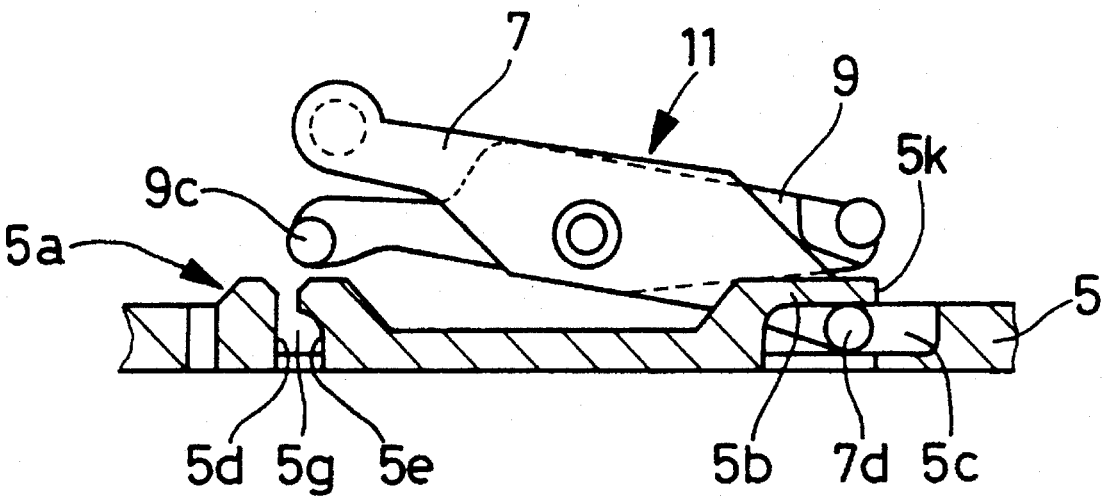

(2) Then, the first and second links 7, 9 are assembled to produce the support linkage 11 in which the second arm portions 9f of the second link 9 are located inside the first arm portions 7f of the first link 7. As shown in FIG. 6(*a*), the second link 9 is first held upright and positioned between the rear end parts of the first arm portions 7f of the first link 7, and then moved toward the middle parts of the arm portions 7f. The first link 7 is then elastically deformed so as to increase the distance between the two first arm portions 7f, and the bosses 9h of the second link 9 are inserted into the holes 7h of the first link 7.

(3) The support linkage 11 is then attached to the holder 5. To begin with, the first and second links 7, 9 are folded such that the two links 7, 9 have the smallest distances between the corresponding ends, as shown in FIG. 6(*b*). Then, the sliding pins 7d of the first link 7 are introduced into the engaging grooves 5c of the rear bearing portions 5b of the holder 5, through the inlets 5k as shown in FIG. 6(*b*). Subsequently, the sliding pivot pins 7d are moved in the left direction as seen in FIG. 6(*b*) all the way to the end of the engaging grooves 5c. In this condition, the stationary pivot pins 9c of the second link 9 are positioned right above the front bearing portions 5a of the holder 5, and the links 7, 9 are pressed down so as to force the stationary pivot pins 9c into respective bearing holes 5g defined by and between the auxiliary and primary bearing surfaces 5d, 5e of the front bearing portions 5a, as indicated in FIGS. 6(*b*) and 7(*a*). At this time, the end portion of the cantilever 5j having the auxiliary bearing surface 5d at each front bearing portion 5a elastically yields, allowing easy press-fitting of the pin 9c into the bearing hole 5g.

(4) Finally, the keytop 3 is attached to the support linkage 11, which has thus been attached to the holder 5. More specifically described, the keytop 3 is positioned as shown in FIG. 7(*a*), such that the front bearing portions 3a rest on the stationary pivot pins 7c of the first link 7 while the rear bearing portions 3b rest on the sliding pivot pins 9d of the second link 9. Then, the keytop 3 is pressed down with a relatively small force, so that the two engaging projections 3c of the keytop 3 are moved away from each other by elastic deformation. Thus, the engaging projections 3c elastically yield to allow the stationary pivot pins 7c to be pressed into the bearing holes 3g defined by and between the two projections 3c. On the other hand, the slant end faces 3f of the rear bearing portions 3b of the keytop 3 are forced against the sliding pivot pins 9d of the second link 9. At this time, the abutting projections 9e formed adjacent to the sliding pivot pins 9d of the second link 9 are brought into abutting contact with the upper surface areas 7i of the first link 7, as indicated in FIG. 7(*a*), whereby the rear end portions 9b of the second link 9 are supported by the underlying rear end portions 7b of the first link 7. Thus, the rear end portions 9b of the second link 9 are prevented from being deflected downward when the rear end portions 9b are pressed down by the keytop 3. As a result, the rear end portions 9b are moved first inwardly of the link 9, as indicated by arrows C in FIG. 7(*b*), and then outwardly of the link 9, due to elastic deformation of the second arm portions 9f. As a result, the sliding pivot pins 9d are eventually engaged with the engaging grooves 3e of the rear bearing portions 3b of the keytop 3, as indicated in FIG. 7(*c*). Thus, the arm portions 9f elastically yield to allow the engagement of the pivot pins 9d with the engaging grooves 3e.

There will be described an operation of the key switch 1 constructed and assembled as described above.

When the keytop 3 of the key switch 1 is pressed down from the position of FIG. 1, the first link 7 is pivoted counterclockwise (as seen in FIG. 1) about the common primary pivot shaft 22 (holes 7h) and about the stationary pivot pins 7c at the front bearing portions 3a of the keytop 3, while the second link 9 is pivoted clockwise (as seen in FIG. 1) about the pivot shaft 22 (bosses 9h) and about the stationary pivot pins 9c at the front bearing portions 5a of the holder 5, such that the sliding pivot pins 7d slide to the right within the engaging grooves 5c of the holder 5 while the sliding pivot pins 9d slide to the right within the engaging grooves 3e of the holder 5.

As a consequence, the pivot 22 at which the first and second links 7, 9 are pivotally connected to each other is moved down, whereby the rubber spring 13 is gradually pressed down by the presser portion 9i of the second link 9, and eventually collapsed due to elastic deformation. Thus, the downward movement of the keytop 3 results in downward movement of the movable electrode 21 attached to the top wall of the rubber spring 13, and eventual abutting contact of the movable electrode 21 with the stationary electrodes 23a, 23b disposed on the flexible circuit board 15, whereby the key switch 1 is closed.

When a force acting on the keytop 3 is released, the presser portion 9i of the second link 9 is pushed upward under the resilient force of the rubber spring 13, whereby the pivot 22 is moved up with the links 7, 9 pivoted in the directions opposite to those when the keytop 3 is pressed. Consequently, the keytop 3 is returned to the original position of FIG. 1. It is noted that the first and second links 7, 9 connected to the holder 5 and keytop 3 as described above permit the keytop 3 to be displaced in the vertical direction without horizontal displacement, while the top surface of the keytop 3 is held substantially in the horizontal plane.

The keytop 3 can be removed from the support linkage 11 (first and second links 7, 9) in the following manner.

If the keytop 3 is replaced by another for some reason or other, the keytop 3 is pulled up in the condition of FIG. 1, and the two engaging projections 3c of the front bearing portions 3a of the keytop 3 are elastically deformed by the stationary pivot pins 7c of the first link 7, so that the engaging projections 3c are moved in the opposite directions away from each other, whereby the engaging projections 3c are removed from the stationary pivot pins 7c of the first link 7. On the other hand, a force is transmitted from the rear bearing portions 3b of the keytop 3 to the sliding pins 9d of the second link 9 in the upward direction, so that the second arm portions 9f first undergo elastic torsion or twisting, which causes the sliding pivot pins 9d to be inclined such that the free end of each pin 9d has a higher position. Then, the second arm portions 9f undergo elastic inward bending toward each other, whereby the sliding pins 9d are displaced toward each other inwardly of the second link 9 and are eventually removed from the engaging grooves 3e of the keytop 3.

With an upward pull force acting on the keytop 3, the stationary pivot pins 9c of the second link 9 and the sliding pivot pins 7d of the first link 7 tend to move toward each other as well as in the upward direction. However, the primary bearing surfaces 5e of the front bearing portions 5a prevent the stationary pivot pins 7d from being removed from the open bearing holes 5g of the front bearing portions 5a of the holder 5. With the sliding pivot pins 7d of the first link 7 being forced against the rear bearing portions 5b of the holder 5, the sliding pivot pins 7d of the first link 7 tend to be elastically deformed and displaced toward each other inwardly of the link 7, as indicated by arrows A in FIG. 3. However, the inward movements of the sliding pins 7d are prevented by the stops 5f which are provided on the holder 5 and which have a sufficient height larger than the diameter of the pins 7d. Therefore, the rear bearing portions 5b and the stops 5f cooperate to prevent the sliding pins 7d from being removed from the engaging grooves 5c of the front bearing portions 5b of the holder 5.

As described above, only the keytop 3 is removed from the support linkage 11, with the linkage 11 being kept attached to the holder 5, when the keytop 3 is pulled up for removal.

In the present key switch 1, the second link 9 is provided with the abutting projections 9e near the sliding pins 9d. These abutting projections 9e are brought into abutting contact with the upper surface areas 7i of the rear end portions 7b of the first link 7 when the sliding pivot pins 9d are pressed down by the rear bearing portions 3b of the keytop 3 when the keytop 3 is pressed against the support linkage 11 for attachment of the keytop 3 to the linkage 11. Consequently, the rear end portions 9b of the second link 9 are supported by the rear end portions 7b of the first link 7, and are therefore prevented from being elastically deformed or deflected in the downward direction when the sliding pivot pins 9d are forced into the engaging grooves 3e of the keytop 3. In other words, the abutting projections 9e function to limit the amount of relative pivotal movement of the two links 7, 9 in a direction that permits the keytop 3 and the holder 5 to move toward each other. Thus, the present arrangement assures easy attachment of the keytop 3 to the sliding pins 9d.

In the present embodiment, the stops 5f are disposed adjacent to the rear end portion 7b of the first link 7 such that the rear end portion 7b is interposed between the stops 5f and the rear bearing portions 5b which engage the pivot pins 7d. The stops 5f can be formed with a height larger than the diameter of the sliding pivot pins 7d, as shown in FIG. 5, because the stops 5f do not interfere with any part of the first or second link 7, 9 during assembling or operation of the key switch 1. In this respect, it is noted that the rear end portions (permanently connected end portion) 7b of the first link 7 do not have any inward projections, and that the second link 9 has the outwardly extending abutting projections 9e at the rear end portions 9d. The sufficient height of the stops 5f assures prevention of elastic inward displacement of the rear end portions 7b of the first link 7, thereby avoiding resulting removal of the sliding pivot pins 7d from the engaging grooves 5c of the holder 5 when the keytop 3 is removed from the support linkage 11.

It is also noted that the absence of any inward projections at the rear end portions 7b of the first link 7 permits easy assembling of the first and second links 7, 9 such that the second link 9 is positioned inwardly of the first link 7, as indicated in FIG. 6(*a*).

Figure 8A:
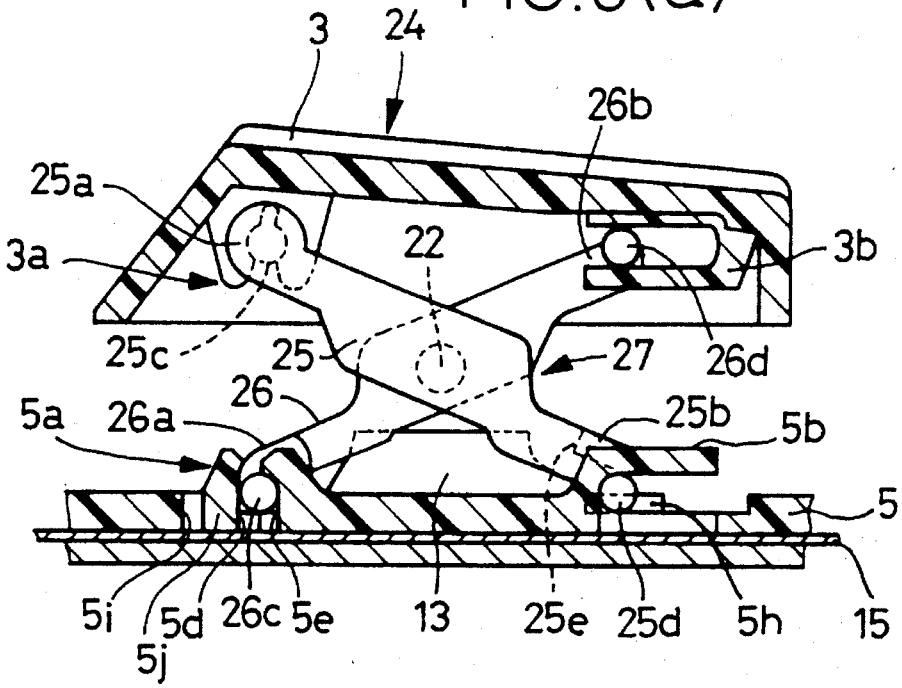
FIG. 8(*a*) is an elevational view in cross section of a key switch according to a second embodiment of this invention.
Figure 8B:
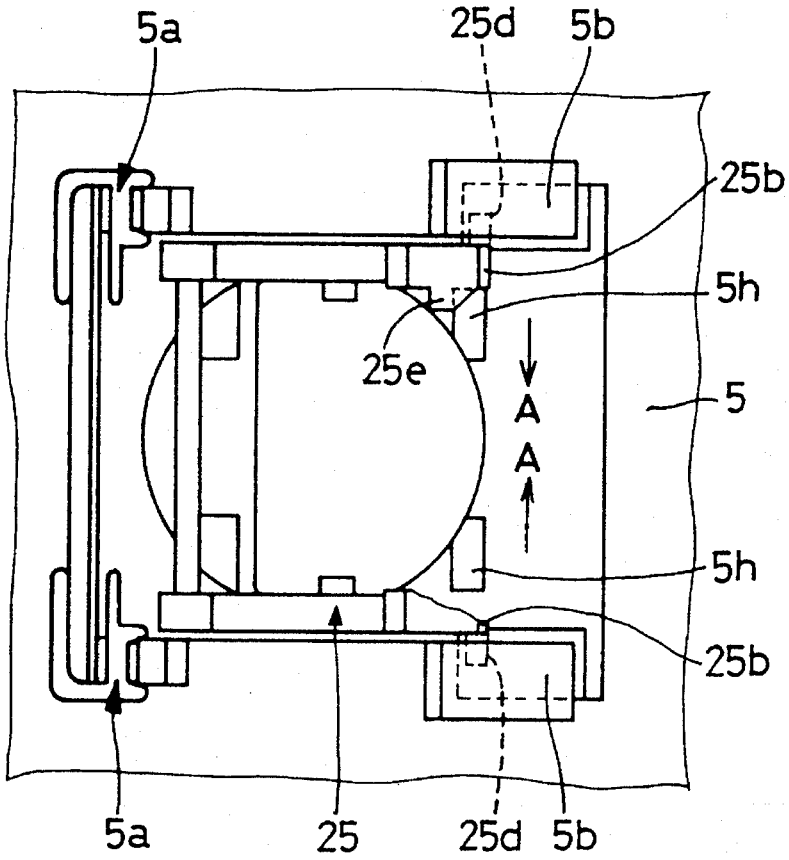
Figure 9:
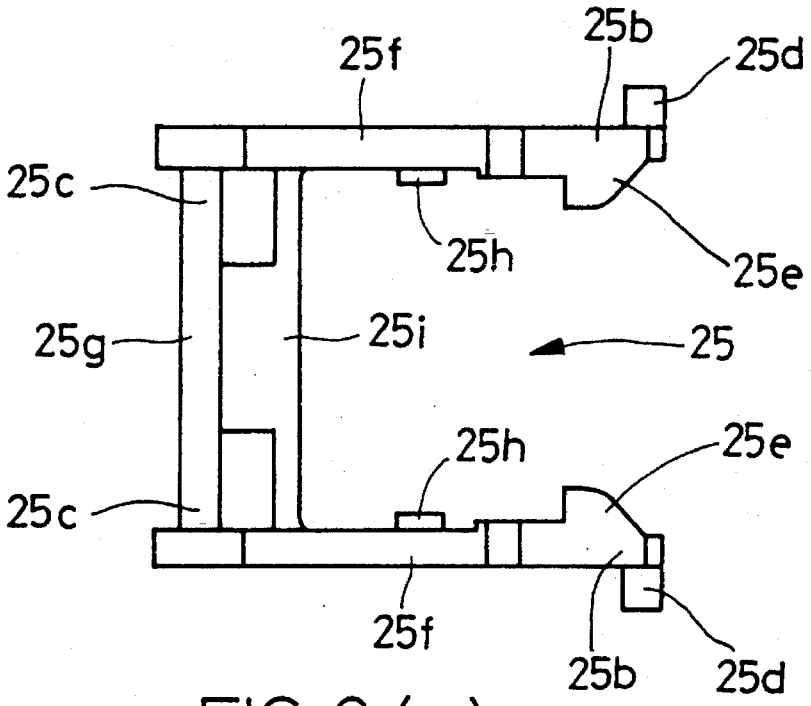
FIGS. 9(*a*) and 9(*b*) are plan views of a first and a second link of the key switch of FIG. 8(*a*)
Figure 9:
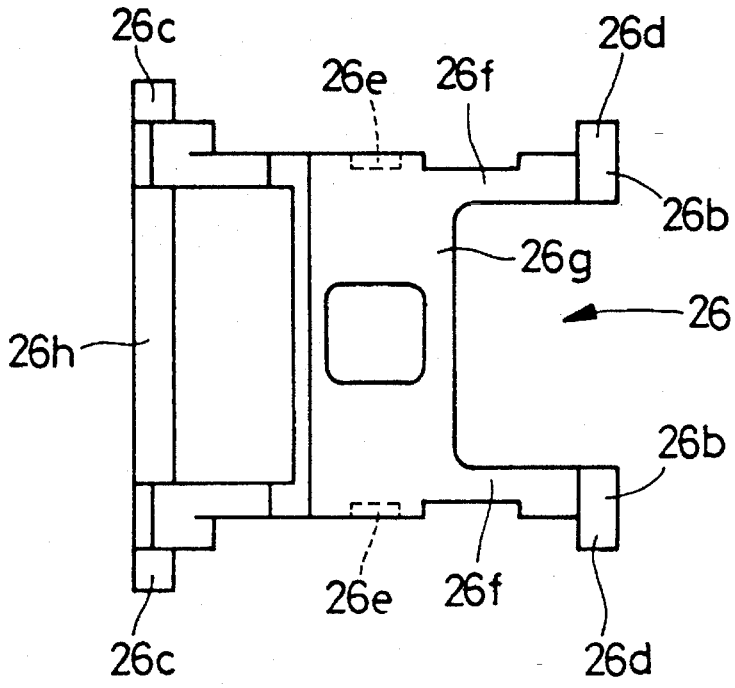

Referring next to FIGS. 8 and 9, there will be described a key switch 24 constructed according to a second embodiment of the present invention. In the interest of brevity and simplification, the same reference numerals as used in FIGS. 1, 3 and 4 are used in FIGS. 8 and 9 to identify the structurally identical elements.

The key switch 24 uses a scissors-type support linkage 27 as shown in FIG. 8(*a*). The linkage 27 consists of a first link 25 and a second link 26 as shown in FIGS. 9(*a*) and 9(*b*). Like the links 7 and 9 used in the first embodiment, these links 25, 26 are generally U-shaped and H-shaped, respectively, each having a pair of arm portions 25f, 26f and a connecting portion 25i (25g), 26g. Unlike the first link 7 having no inward projections, however, the first link 25 has two abutting portions in the form of inward projections 25e as shown in FIG. 9(*a*). These inward projections 25e are formed at the rear end portions 25b of the first link 25 so as to extend inwardly of the link 25. On the other hand, the second link 26 has no abutting projections, unlike the second link 9 which has the outwardly extending abutting projections 9e. The rear end portions 26b of the second link 26 are brought into abutting contact with the abutting projections 25e of the first link 25 when the sliding pivot pins 26d of the second link 26 are forced into the engaging grooves 3e formed at the rear bearing portions 3b of the keytop 3 during assembling of the key switch 24. The abutting projections 25e of the first link 25 have the same functions as the abutting projections 9e of the second link 9.

The support linkage 27 is also different from the support linkage 11 of the first embodiment in that the second link 26 has another connecting portion in the form of a pivot rod 26h at the front end portion, and in that the first link 25 has bosses 25h while the second link 26 has holes 26e for engagement with the bosses 25h.

As shown in FIG. 8(*b*), the holder 5 has two stops 5h which have the same function as the stops 5f used in the first embodiment. For avoiding an interference between the stops 5h and the inwardly extending abutting projections 25e of the first link 25, the height of the stops 5h is made relatively small, more precisely, almost equal to a half of the diameter of the sliding pins 26d of the second link 26, as indicated in FIG. 8(*a*).

Figure 10:
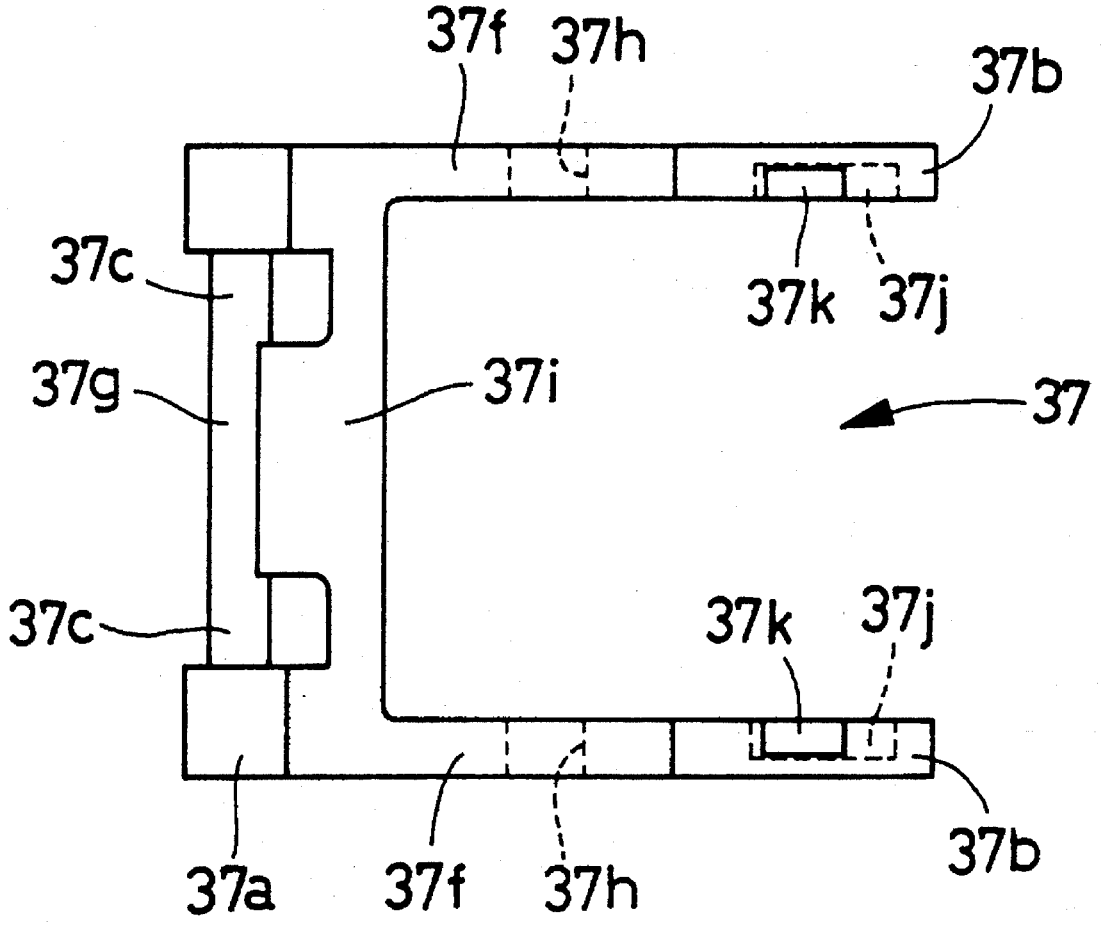
FIG. 10 is a plan view of a first link used in a key switch used in a third embodiment of the present invention.

Referring to FIG. 10, there will be described a third embodiment of this invention. In this embodiment, the support linkage uses a first link 37 shown in FIG. 10, and the second link 9 shown in FIG. 4(*b*). As in the preceding embodiments, the first and second links 37, 9 are assembled such that the first arm portions, 37f of the first link 37 are located inside the second arm portions 9f of the second link 9. However, the stationary pivot pins 9c and the sliding pivot pins 9d of the second link 9 are attached to the front bearing portions 3a of the keytop 3 and the rear bearing portions 5b of the holder 5, respectively. Accordingly, the stationary pivot pins 37c at the front end portion 37a of the first link 37 are connected to the front bearing portions 5a of the holder 5, while the rear end portions 37b of the second arms 37f of the first link 37 are connected to the keytop 3. For this purpose, the arm portions 37f have respective rear bearing portions having elongated engaging grooves 37j which are open toward each other inwardly of the link 37. These engaging grooves 37j are adapted to engage respective stationary pivot pins formed on the underside of the keytop 3, so that the rear end portions 37b are movable relative to the pivot pins. For inserting the pivot pins into the engaging grooves 37j, the engaging grooves 37j are provided with inlets 37k.

The third embodiment of FIG. 10 may be modified such that the arm portions 37f have respective stationary pivot pins while the keytop 3 have the corresponding elongated engaging grooves, namely, rear bearing portions.

Reference is now made to FIGS. 11–14 showing a fourth embodiment of the present invention which uses a support linkage 40.

Figure 11:
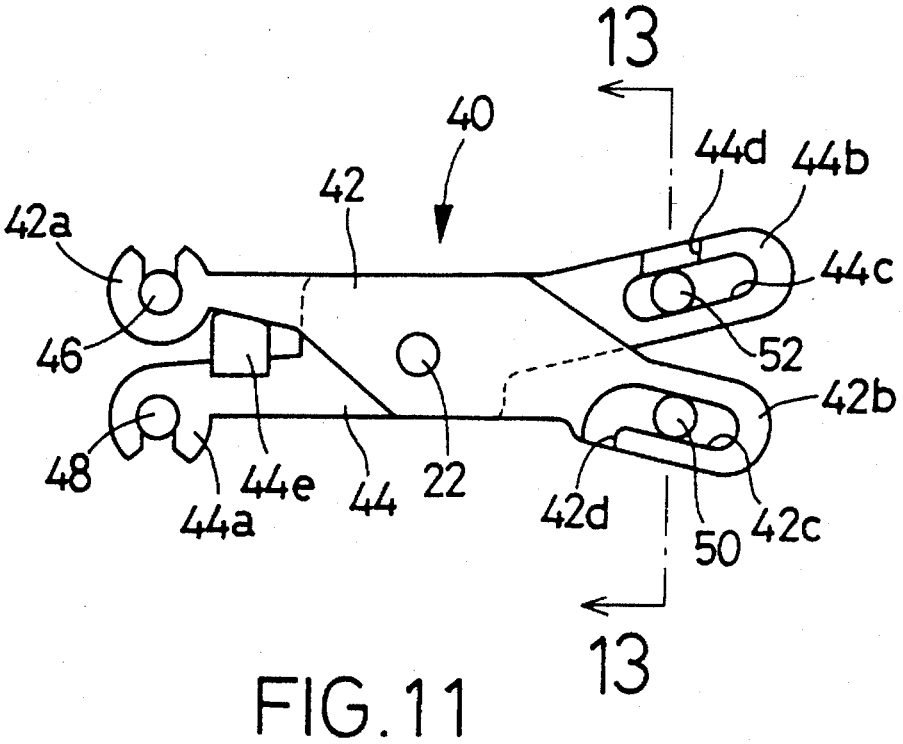
FIGS. 11 and 12 are elevational views of first and second links used in a fourth embodiment of this invention
Figure 12:
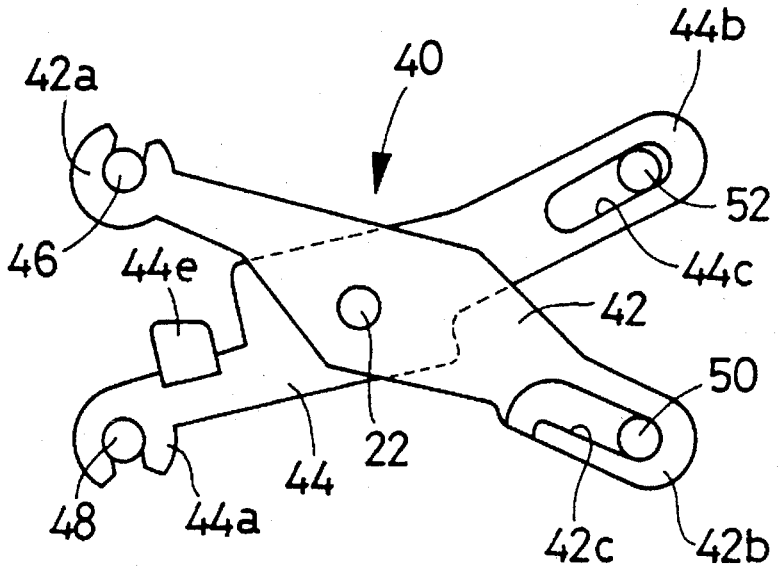
Figure 13:
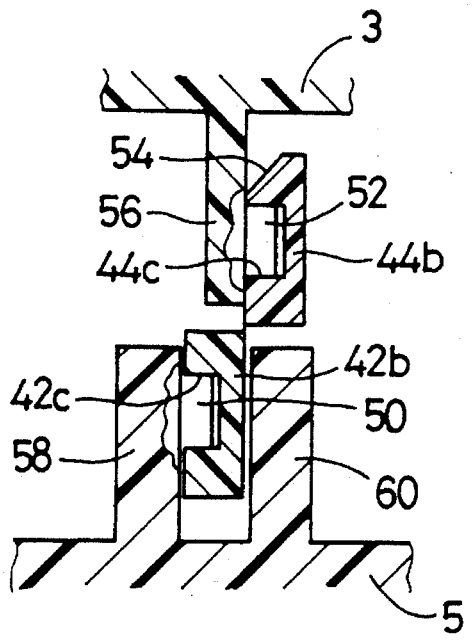
FIG. 13 is a cross sectional view taken along line 13—13 in FIG. 11, showing the first and second links of FIGS. 11 and 12 in their state of FIG. 11, and portions of a keytop and a holder of the key switch.
Figure 14:
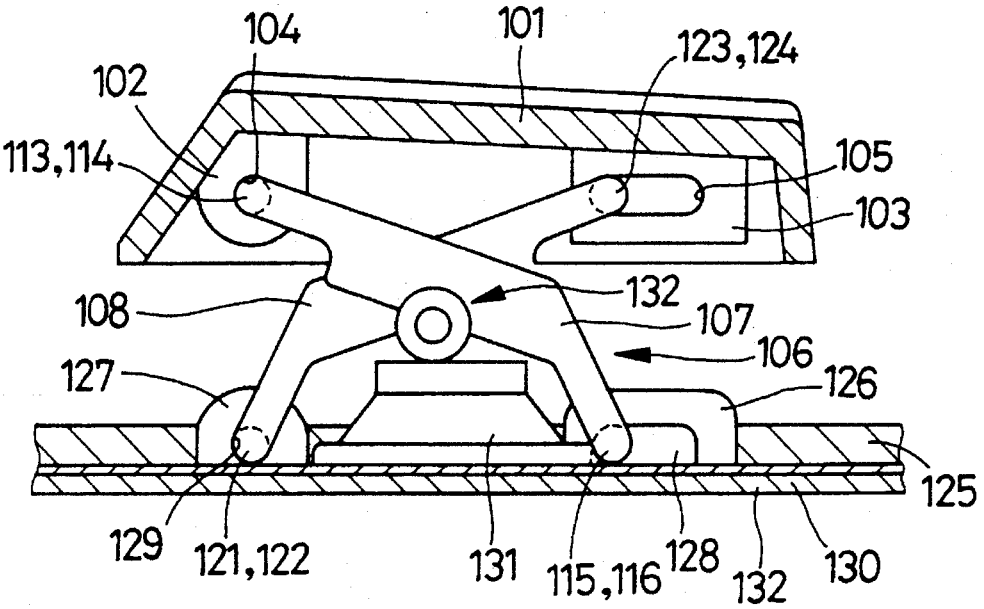
FIG. 14 PRIOR ART
FIG. 14 is an elevational view in cross section of a known key switch.
Figure 15:
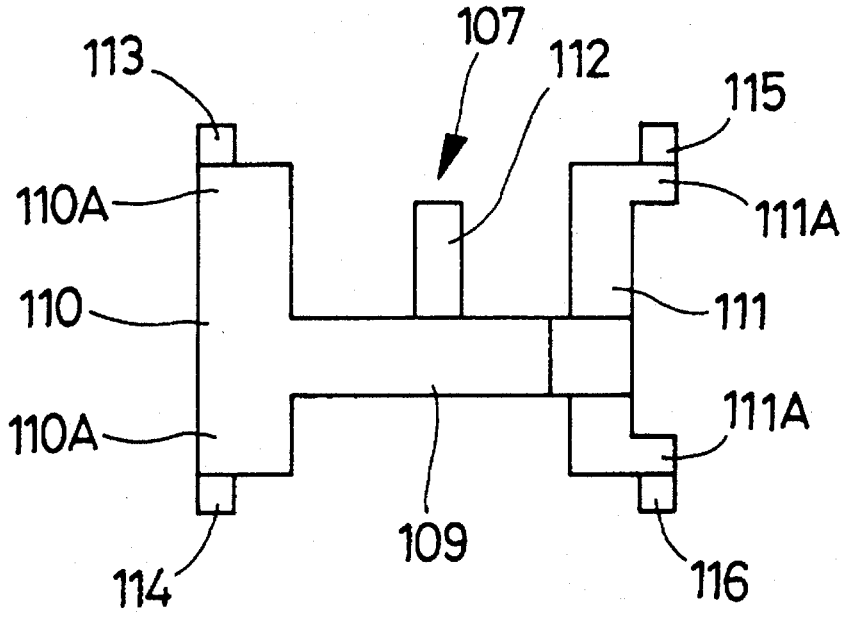
FIG. 15 PRIOR ART
FIG. 15 is a plan view of a first link of the key switch of FIG. 14.
Figure 16:
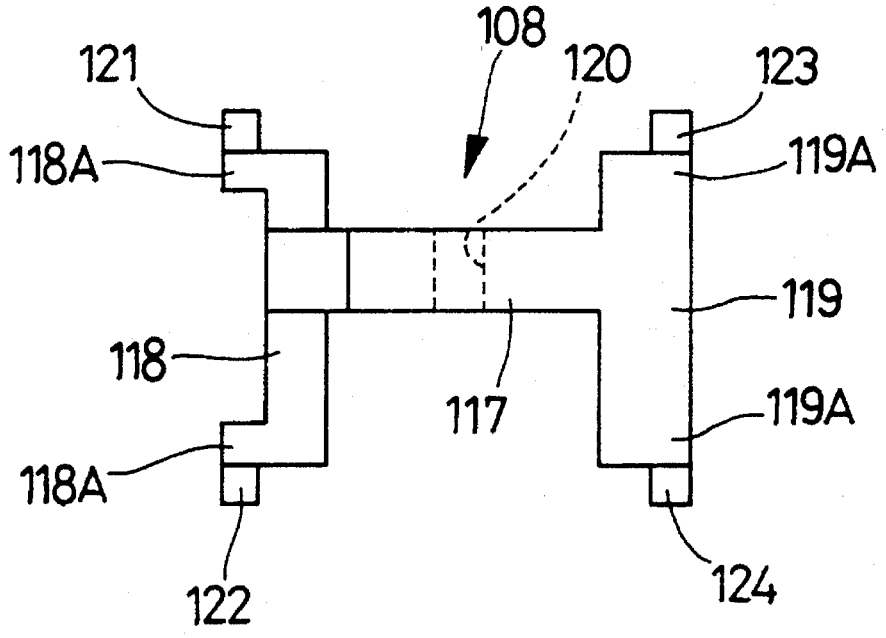
FIG. 16 PRIOR ART
FIG. 16 is a plan view of a second link of the key switch of FIG. 14.

In the first and second embodiments, the links 7, 9, 25, 26 have the pivot pins 7c, 7d, 9c, 9d, 25c, 25d, 26c, 26d as shown in FIGS. 4(*a*), 4(*b*), 9(*a*) and 9(*b*). In the present fourth embodiment of FIGS. 11–14, however, first and second links 42, 44 of the support linkage 40 have bearing portions 42a, 42b, 44a, 44b. The front bearing portions 42a, 44a of the two links 42, 44 are adapted to engage respective stationary pivot pins 46, 48 provided on the keytop 3 and holder 5, respectively. The rear bearing portions 42b of the first link 42 have elongated engaging grooves 42c each of which is open generally downward at an inlet 42d, as shown in FIG. 11. These engaging grooves 42c are adapted to receive respective pivot pins 50 provided on the holder 5, as shown in FIG. 13. The rear bearing portions 44b of the second link 44 have elongated engaging grooves 44c each of which is open generally upward at an inlet 44d, as shown in FIG. 11. The engaging grooves 44c are adapted to receive respective pivot pins 52 provided on the keytop 3, as shown in FIG. 13. The pins 50, 52 are introduced into the grooves 42c, 44c through the inlets 42d, 44d.

Each rear bearing portion 44b of the second link 44 has an inclined surface 54 at the inlet 44d, so that the pivot pins 52 may be easily forced into the engaging groove 44c by elastic deformation of the rear end portion 44b and a support portion 56 of the keytop 3 from which the pin 52 extends. Thus, the support portion 56 and the rear end portion 44b elastically yield to allow removal of the pins 52 from the grooves 44*c* when the keytop 3 is removed from the support linkage 40.

Each rear end portion 42*b* is interposed between a support portion 58 of the holder 5 from which the pin 50 extends, and a stop wall 60 formed on the holder 5 in parallel to the support wall 58. These support portion 58 and stop wall 60 cooperate to prevent elastic deformation of the rear end portion of the first link 42, and there retaining the pin 50 in the engaging groove 42*c* when the keytop 3 is removed from the support linkage 40.

In the present embodiment, the second link 44 has abutting projections 44*e* near the front bearing portions 44*a*. These abutting projections 44*e* extend outwardly of the second link 44 so that the projections 44*e* are abuttable on the corresponding parts of the first link 42, as indicated in FIG. 11, when the support linkage 40 is operated from the position of FIG. 12 to the position of FIG. 11.

While the elongated engaging grooves 42*c*, 44*c* are formed straight, it is desirable that these grooves 42*c*, 44*c* are curved with a suitable arc radius so that the keytop 3 maintains the same posture during its entire operating stroke.

While the present invention has been described in detail in its presently preferred embodiments, it is to be understood that the invention is not limited to the details of the illustrated embodiments, but may be embodied with various changes, modifications and improvements, which may occur to those skilled in the art without departing from the spirit and scope of the invention defined in the following claims.

What is claimed is:

1. A key switch comprising:

a keytop;

a holder spaced apart from and opposed to said keytop;

a support linkage for connecting said keytop and said holder such that said keytop is movably supported and guided by said support linkage;

a switching portion operated by movements of said keytop to effect a switching action;

said support linkage including a first link and a second link which are connected to each other in the form of scissors pivotally about a common primary pivot shaft;

said first link being generally U-shaped and including a pair of first arm portions and a first connecting portion which connect said first arm portions at corresponding fixed ends thereof such that said first arm portions are parallel to each other;

said second link being generally H-shaped and including a pair of second arm portions and a second connecting portion which connect said second arm portions at least at middle parts thereof such that said second arm portions are parallel to each other;

one of said pairs of first and second arms having a pair of bosses while the other of said pairs of first and second arms has a pair of holes, said first and second links being connected pivotally relative to each other such that said second arms are disposed inside said first arms and such that said pair of bosses engage said pair of holes so as to provide said common primary pivot shaft;

each of opposite end portions of each of said first and second links having one of a secondary pivot shaft and a bearing portion, while each of four portions of said keytop and said holder which correspond to said opposite end portions of said first and second links having the other of said secondary pivot shaft and said bearing portion, said bearing portion engaging said secondary pivot shaft mutually pivotally about an axis of said secondary pivot shaft; and said second arms having an abutting portion at the end portions thereof pivotally connected to said keytop through said secondary pivot shaft and said bearing portion, said abutting portion extending outwardly of said second link, for abutting contact with a corresponding portion of said first arms so as to limit an amount of movements of said keytop toward said holder.

2. A key switch comprising:

a keytop;

a holder spaced apart from and opposed to said keytop;

a support linkage for connecting said keytop and said holder such that said keytop is movably supported and guided by said support linkage, said support linkage including a first link and a second link which are connected to each other in the form of scissors pivotally about a common primary pivot shaft, each of opposite end portions of each of said first and second links having one of a secondary pivot shaft and a bearing portion, while each of four portions of said keytop and said holder which correspond to said opposite end portions of said first and second links having the other of said secondary pivot shaft and said bearing portion, said bearing portion supporting said secondary pivot shaft at least pivotally about an axis of said secondary pivot shaft;

a switching portion operated by movements of said keytop to effect a switching action;

said secondary pivot shafts including at least one special secondary pivot shaft which is carried by a special support portion, and said bearing portions including at least one special bearing portion which engages said at least one special secondary pivot shaft; and at least one of said special support portion and the corresponding special bearing portion including an elastic portion which elastically yields to allow engagement of said special secondary pivot shaft and said special bearing portion when said keytop is moved toward said holder with said support linkage being interposed between said keytop and said holder before the engagement of said special secondary pivot shaft and said special bearing portion, wherein said first link is generally U-shaped and includes a pair of first arm portions and a first connecting portion, which connects said first arm portions at corresponding fixed ends thereof such that said first arm portions are parallel to each other, and wherein said second link is generally H-shaped and includes a pair of second arm portions and a second connecting portion, which connects said second arm portions at least at middle parts thereof such that said second arm portions are parallel to each other, and wherein one of said pairs of first and second arm portions has a pair of bosses while the other of said pairs of first and second arm portions has a pair of holes, said first and second links being connected pivotally relative to each other such that said second arm portions are disposed inside said first arm portions and such that said pair of bosses engage said pair of holes so as to provide said common primary pivot shaft.

3. A key switch according to claim 2, wherein said at least one special bearing portion includes an open bearing portion having an open bearing hole which pivotally receives the corresponding special secondary pivot shaft, said open bearing hole having an inner portion and an open end which has a smaller dimension than said inner portion as measured in a direction perpendicular to a direction of movement of said keytop, said open bearing portion elastically yielding to permit the corresponding special secondary pivot shaft to move into and out of said inner portion of said open bearing hole through said open end, and wherein at least one of said pair of first arm portions and said pair of second arm portions carries the special secondary pivot shafts at end portions of said arm portions, said end portions of said at least one of said pairs of first and second arm portions being connected by said connecting portion.

4. A key switch according to claim 2, wherein said second connecting portion of said second link includes a presser portion which acts on said switching portion to effect the switching action when the keytop is moved toward the holder.

5. A key switch according to claim 2, wherein the secondary pivot shafts for connecting one of the opposite ends of each of said first and second links to said keytop and the secondary pivot shafts for connecting the other of the opposite ends of each of said first and second links include at least one secondary pivot shaft which is formed on said keytop or said holder and which engages at least one bearing portion formed on said first link or said second link.

6. A key switch comprising:

a keytop;

a holder spaced apart from and opposed to said keytop;

a support linkage for connecting said keytop and said holder such that said keytop is movably supported and guided by said support linkage, said support linkage including a first link and a second link which are connected to each other in the form of scissors pivotally about a common primary pivot shaft, each of opposite end portions of each of said first and second links having one of a secondary pivot shaft and a bearing portion, while each of four portions of said keytop and said holder which correspond to said opposite end portions of said first and second links having the other of said secondary pivot shaft and said bearing portion, said bearing portion supporting said secondary pivot shaft at least pivotally about an axis of said secondary pivot shaft;

a switching portion operated by movements of said keytop to effect a switching action;

said secondary pivot shafts including at least one special secondary pivot shaft which is carried by a special support portion, and said bearing portions including at least one special bearing portion which engages said at least one special secondary pivot shaft; and at least one of said special support portion and the corresponding special bearing portion including an elastic portion which elastically yields to allow engagement of said special secondary pivot shaft and said special bearing portion when said keytop is moved toward said holder with said support linkage being interposed between said keytop and said holder before the engagement of said special secondary pivot shaft and said special bearing portion, wherein one of said first and second links has an abutting portion which is abuttable against the other of said first and second links so as to limit an amount of relative pivotal movement of said first and second links in a direction that permits said keytop and said holder to move toward each other.

7. A key switch according to claim 6, wherein said abutting portion provided on said one of said first and second links is located near the secondary pivot shaft which is forced into engagement with one of said bearing portions of said keytop during assembly of the key switch, said abutting portion being formed on said one of said first and second links, for abutting contact with a corresponding portion of the other of said first and second links when said secondary pivot shaft on said one of said first and second links is forced into engagement with said one of said bearing portions of said keytop.

8. A key switch according to claim 6, wherein the secondary pivot shafts for connecting one of the opposite ends of each of said first and second links to said keytop and the secondary pivot shafts for connecting the other of the opposite ends of each of said first and second links include at least one secondary pivot shaft which is formed on one of said keytop and said holder and which engages at least one bearing portion formed on one of said first link and said second link.

9. A key switch comprising:

a keytop;

a holder spaced apart from and opposed to said keytop;

a support linkage for connecting said keytop and said holder such that said keytop is movably supported and guided by said support linkage, said support linkage including a first link and a second link which are connected to each other in the form of scissors pivotally about a common primary pivot shaft, each of opposite end portions of each of said first and second links having one of a secondary pivot shaft and a bearing portion, while each of four portions of said keytop and said holder which correspond to said opposite end portions of said first and second links having the other of said secondary pivot shaft and said bearing portion, said bearing portion supporting said secondary pivot shaft at least pivotally about an axis of said secondary pivot shaft;

a switching portion operated by movements of said keytop to effect a switching action;

said secondary pivot shafts including at least one special secondary pivot shaft which is carried by a special support portion, and said bearing portions including at least one special bearing portion which engages said at least one special secondary pivot shaft; and at least one of said special support portion and the corresponding special bearing portion including an elastic portion which elastically yields to allow engagement of said special secondary pivot shaft and said special bearing portion when said keytop is moved toward said holder with said support linkage being interposed between said keytop and said holder before the engagement of said special secondary pivot shaft and said special bearing portion, wherein said first link includes a pair of first arm portions and a first connecting portion, which connects said first arm portions at corresponding fixed ends thereof, and said second link includes a pair of second arm portions and a second connecting portion, which connects said second arm portions at least at middle parts thereof, wherein at least one of said pair of second arm portions of said second link has an abutting portion which is abuttable against at least one of said pair of first arm portions of said first link so as to limit an amount of relative pivotal movement of said first and second links in a direction that permits said keytop and said holder to move toward each other, said abutting portion being formed at an end of said at least one second arm portion which is moved toward a free end of said first link remote from said fixed end when said keytop is moved toward said holder, said abutting portion extending from said at least one second arm portion in a direction parallel to an axis of said common primary pivot shaft and outwardly of said second link.

10. A key switch according to claim 9, wherein the secondary pivot shafts for connecting one of the opposite ends of each of said first and second links to said keytop and the secondary pivot shafts for connecting the other of the opposite ends of each of said first and second links include at least one secondary pivot shaft which is formed on one of said keytop and said holder and which engages at least one bearing portion formed on one of said first link and said second link.

11. A key switch comprising:

a keytop;

a holder spaced apart from and opposed to said keytop;

a support linkage for connecting said keytop and said holder such that said keytop is movably supported and guided by said support linkage, said support linkage including a first link and a second link which are connected to each other in the form of scissors pivotally about a common primary pivot shaft, each of opposite end portions of each of said first and second links having one of a secondary pivot shaft and a bearing portion, while each of four portions of said keytop and said holder which correspond to said opposite end portions of said first and second links having the other of said secondary pivot shaft and said bearing portion, said bearing portion supporting said secondary pivot shaft at least pivotally about an axis of said secondary pivot shaft;

a switching portion operated by movements of said keytop to effect a switching action;

said secondary pivot shafts including at least one special secondary pivot shaft which is carried by a special support portion, and said bearing portions including at least one special bearing portion which engages said at least one special secondary pivot shaft; and at least one of said special support portion and the corresponding special bearing portion including an elastic portion which elastically yields to allow engagement of said special secondary pivot shaft and said special bearing portion when said keytop is moved toward said holder with said support linkage being interposed between said keytop and said holder before the engagement of said special secondary pivot shaft and said special bearing portion, wherein removal facilitating means is provided for facilitating removal of said keytop from said support linkage prior to removal of said support linkage from said holder when a force is applied to said keytop in a direction away from said holder after said first and second links are connected to said keytop and said holder.

12. A key switch according to claim 11, wherein said at least one special bearing portion includes two open bearing portions which are opposed to each other and which are provided on the side of said keytop and said holder, respectively, said two open bearing portions having respective open bearing holes which pivotably receive the corresponding special secondary pivot shafts, each of said open bearing hole having an inner portion and an open end which has a smaller dimension than said inner portion as measured in a direction perpendicular to a direction of movement of said keytop, each of said two open bearing portions elastically yielding to permit the corresponding special secondary pivot shaft to move into and out of said inner portion of said open bearing hole through said open end, and wherein said removal facilitating means comprises one of said two open bearing portions which is provided on the side of said keytop and which is shaped so as to permit removal of said corresponding special secondary pivot shaft therefrom prior to removal of the special secondary pivot shaft from the other of said two open bearing portions which is provided on the side of said holder.

13. A key switch according to claim 12, wherein said open bearing portion provided on the side of said holder consists of an offset type open bearing portion wherein said open end of said open bearing hole is offset from a center of said inner portion of said open bearing hole in an offset direction away from another bearing portion provided on the side of said holder.

14. A key switch according to claim 13, wherein said holder has an opening formed through an entire thickness thereof, and a cantilever which extends into said opening from a surface of said opening parallel to said offset direction, said opening having a primary bearing surface perpendicular to said offset direction, said cantilever having a free end portion which has an auxiliary bearing surface and which cooperates with said primary bearing surface to define said open bearing hole of said offset type bearing portion.

15. A key switch according to claim 11, wherein said at least one special bearing portion includes two open bearing portions which are opposed to each other and which are provided on the side of said keytop and said holder, respectively, said two open bearing portions having respective open bearing holes which pivotably receive the corresponding special secondary pivot shafts and which are open toward each other, each of said two open bearing holes having a smaller dimension at an open end thereof than at an inner portion thereof, as measured in a direction perpendicular to a direction of movement of said keytop, each of said two open bearing portions elastically yielding to permit the corresponding special secondary pivot shaft to move into and out of said inner portion of said open bearing hole through said open end, and wherein said removal facilitating means comprises another bearing portion provided on the side of said holder, said another bearing portion comprising stop means for inhibiting a movement of the secondary pivot shaft which engages said another bearing portion, in a direction toward said open bearing portion provided on the side of said holder, at least when said keytop is moved away from said holder to remove said keytop from said support linkage.

16. A key switch according to claim 11, wherein said removal facilitating means comprises deformation limiting means for limiting elastic deformation of the end portion of one of said first and second links, which end portion is connected to said holder as a permanently connected end portion and does not have said special support portion.

17. A key switch according to claim 16, wherein said deformation limiting means comprises stops disposed adjacent to said permanently connected end portion of said one of the first and second links such that said permanently connected end portion is interposed between said stops and the bearing portion which engages said secondary pivot shaft carried by said permanently connected end portion, said stops preventing elastic deformation of said permanently connected end portion in a direction away from said bearing portion.

18. A key switch according to claim 17, wherein said bearing portion adjacent to said permanently connected end portion which is disposed adjacent to said stops has an engaging groove which permits a sliding movement of said secondary pivot shaft in a direction substantially perpendicular to a direction of movements of said keytop, and an inlet which communicates with one end of said engaging groove and which is open in a direction away from said holder, said bearing portion adjacent to said connected fixed end portion being shaped so as not to prevent a movement of said secondary pivot shaft into said engaging groove through said inlet.

19. A key switch according to claim 17, wherein at least one of said second arm portions has an abutting portion which is abuttable against at least one of said first arm portions so as to limit an amount of relative pivotal movement of said first and second links in a direction that permits said keytop and said holder to move toward each other, said abutting portion being formed at the end of said at least one second arm portion which is connected to said keytop and which corresponds to said free ends of said first arm portion.

20. A key switch according to claim 17, wherein said stops have a larger height than said secondary pivot shaft carried at said free ends of said first arm portions, as measured in a direction from said holder toward said keytop.

21. A key switch according to claim 16, wherein said first link is generally U-shaped and includes a pair of first arm portions and a first connecting portion which connects said first arm portions at corresponding fixed ends thereof such that said first arm portions are parallel to each other, and said second link being generally H-shaped and including a pair of second arm portions and a second connecting portion which connects said second arm portions at least at middle parts thereof such that said second arm portions are parallel to each other, and wherein one of said pairs of first and second arm portions has a pair of bosses while the other of said pairs of first and second arm portions has a pair of holes, said first and second links being connected pivotally relative to each other such that said second arm portions are disposed inside said first arm portions and such that said pair of bosses engage said pair of holes so as to provide said common primary pivot shaft, said first arm portions carrying the secondary pivot shafts at free ends thereof which are remote from said fixed ends and which are provided on said permanently connected end portion of said first link, said first arm portions being connected at said free ends to said holder such that said secondary pivot shafts extending outwardly of said first link engage the corresponding bearing portions provided on said holder, said second arm portions being connected to said keytop at ends thereof which correspond to said free ends of said first arm portions, said deformation limiting means comprising stops disposed adjacent to said free ends of said arm portions such that said free ends are interposed between said stops and the bearing portions provided on said holder, said stops preventing elastic deformation of said free ends in a direction away from said bearing portion.

22. A key switch according to claim 11, wherein said first link is generally U-shaped and includes a pair of first arm portions and a first connecting portion which connects said first arm portions at corresponding fixed ends thereof such that said first arm portions are parallel to each other, and said second link being generally H-shaped and including a pair of second arm portions and a second connecting portion which connects said second arm portions at least at middle parts thereof such that said second arm portions are parallel to each other, and wherein one of said pairs of first and second arm portions has a pair of bosses while the other of said pairs of first and second arm portions has a pair of holes, said first and second links being connected pivotally relative to each other such that said second arm portions are disposed inside said first arm portions and such that said pair of bosses engage said pair of holes so as to provide said common primary pivot shaft, said removal facilitating means comprising free ends of said first arm portions which are remote from said fixed ends and which are connected to said keytop, and ends of said second arm portions which correspond to said free ends of said first arm portions and which are connected to said holder, each of said first arm portions having at said free end one of the special secondary pivot shaft and the special bearing portion which are formed at an inner portion of said free end, while said keytop having the other of said special secondary pivot shaft and said special bearing portion which engages said one of the special secondary pivot shaft and the special bearing portion.

23. A key switch according to claim 11, wherein the secondary pivot shafts for connecting one of the opposite ends of each of said first and second links to said keytop and the secondary pivot shafts for connecting the other of the opposite ends of each of said first and second links include at least one secondary pivot shaft which is formed on one of said keytop and said holder and which engages at least one bearing portion formed on one of said first link and said second link.

24. A key switch comprising:

a keytop;

a holder spaced apart from and opposed to said keytop;

a support linkage for connecting said keytop and said holder such that said keytop is movably supported and guided by said support linkage, said support linkage including a first link and a second link which are connected to each other in the form of scissors pivotally about a common primary pivot shaft, each of opposite end portions of each of said first and second links having one of a secondary pivot shaft and a bearing portion, while each of four portions of said keytop and said holder which correspond to said opposite end portions of said first and second links having the other of said secondary pivot shaft and said bearing portion, said bearing portion supporting said secondary pivot shaft at least pivotally about an axis of said secondary pivot shaft;

a switching portion operated by movements of said keytop to effect a switching action;

said secondary pivot shafts including at least one special secondary pivot shaft which is carried by a special support portion, and said bearing portions including at least one special bearing portion which engages said at least one special secondary pivot shaft; and at least one of said special support portion and the corresponding special bearing portion including an elastic portion which elastically yields to allow engagement of said special secondary pivot shaft and said special bearing portion when said keytop is moved toward said holder with said support linkage being interposed between said keytop and said holder before the engagement of said special secondary pivot shaft and said special bearing portion, wherein each of said opposite ends of said first and second links has said secondary pivot shaft, and wherein the bearing portion which engages the corresponding secondary pivot shaft provided at one of said opposite ends of each of said first and second links consists of a sliding type bearing portion which supports said corresponding secondary pivot shaft pivotally and slidably movably in a direction substantially perpendicular to a direction of movements of said keytop, and wherein the bearing portion which engages the corresponding secondary pivot shaft provided at the other of said opposite ends of said each of said first and second links consists of a non-sliding type bearing portion which supports said corresponding secondary pivot shaft pivotally and so as to prevent sliding movements of said corresponding secondary pivot shaft in said direction substantially perpendicular to the direction of movement of the keytop.

25. A key switch according to claim 24, wherein at least one of said sliding type bearing portions provided on said keytop and said sliding type bearing portion provided on said holder includes an end portion which has a slant end face formed for abutting engagement with the corresponding secondary pivot shaft during a movement of said corresponding secondary pivot shaft toward said keytop or said holder, for thereby causing elastic deformation of the end portion of said first or second link carrying said corresponding secondary pivot shaft in a direction away from said sliding type bearing portion.

26. A key switch according to claim 24, wherein the secondary pivot shafts for connecting one of the opposite ends of each of said first and second links to said keytop and the secondary pivot shafts for connecting the other of the opposite ends of each of said first and second links include at least one secondary pivot shaft which is formed on one of said keytop and said holder and which engages at least one bearing portion formed on one of said first link and said second link.

27. A key switch comprising:

a keytop;

a holder spaced apart from and opposed to said keytop;

a support linkage for connecting said keytop and said holder such that said keytop is movably supported and guided by said support linkage, said support linkage including a first link and a second link which are connected to each other in the form of scissors pivotally about a common primary pivot shaft, each of opposite end portions of each of said first and second links having one of a secondary pivot shaft and a bearing portion, while each of four portions of said keytop and said holder which correspond to said opposite end portions of said first and second links having the other of said secondary pivot shaft and said bearing portion, said bearing portion supporting said secondary pivot shaft at least pivotally about an axis of said secondary pivot shaft;

a switching portion operated by movements of said keytop to effect a switching action;

said secondary pivot shafts including at least one special secondary pivot shaft which is carried by a special support portion, and said bearing portions including at least one special bearing portion which engages said at least one special secondary pivot shaft; and at least one of said special support portion and the corresponding special bearing portion including an elastic portion which elastically yields to allow engagement of said special secondary pivot shaft and said special bearing portion when said keytop is moved toward said holder with said support linkage being interposed between said keytop and said holder before the engagement of said special secondary pivot shaft and said special bearing portion, wherein the secondary pivot shafts for connecting one of the opposite ends of each of said first and second links to said keytop and the secondary pivot shafts for connecting the other of the opposite ends of each of said first and second links to said holder include at least one secondary pivot shaft which is formed on one of said keytop and said holder and which engages at least one bearing portion formed on one of said first link and said second link.

* * * * *